US006199700B1

(12) United States Patent
Yamamoto et al.

(10) Patent No.: US 6,199,700 B1
(45) Date of Patent: Mar. 13, 2001

(54) CUSHIONING MATERIAL FOR PACKAGING

(75) Inventors: Masahiro Yamamoto, Osaka; Yoshimasa Yokoyama, Kohbe, both of (JP)

(73) Assignees: Hitachi Zosen Corporation; Yokoyama Sankoh Co., Ltd., both of (JP)

( * ) Notice: Subject to any disclaimer, the term of this patent is extended or adjusted under 35 U.S.C. 154(b) by 0 days.

(21) Appl. No.: 09/381,906

(22) PCT Filed: Mar. 27, 1998

(86) PCT No.: PCT/JP98/01415

§ 371 Date: Jan. 27, 2000

§ 102(e) Date: Jan. 27, 2000

(87) PCT Pub. No.: WO98/43891

PCT Pub. Date: Oct. 8, 1998

(30) Foreign Application Priority Data

Mar. 28, 1997 (JP) ..... 9-095182

(51) Int. Cl.[7] ..... B65D 81/05; B65D 85/00

(52) U.S. Cl. ..... 206/586; 206/320

(58) Field of Search ..... 206/320, 453, 206/521, 586, 588, 591, 592

(56) References Cited

U.S. PATENT DOCUMENTS

| | | | | |
|---|---|---|---|---|
| 2,538,671 | | 1/1951 | Crowe . | |
| 2,746,667 | * | 5/1956 | Murphy | 206/588 X |
| 2,914,232 | * | 11/1959 | Budd | 206/592 X |
| 3,159,274 | * | 12/1964 | Burt | 206/521 X |
| 3,281,050 | | 10/1966 | Suchodolski . | |
| 3,434,400 | | 3/1969 | Hochfeld . | |
| 4,200,032 | | 4/1980 | Roda . | |
| 4,320,839 | * | 3/1982 | Skaggs | 206/591 |
| 4,425,111 | | 1/1984 | Chazelas . | |
| 4,578,052 | | 3/1986 | Engel et al. . | |
| 4,792,085 | | 12/1988 | Waring, III et al. . | |

(List continued on next page.)

FOREIGN PATENT DOCUMENTS

| | | |
|---|---|---|
| 53-833777 | 7/1978 | (JP) . |
| 58-61768 | 4/1983 | (JP) . |
| 59-186263 | 11/1984 | (JP) . |
| 59-191356 | 12/1984 | (JP) . |
| 46-37998 | 12/1985 | (JP) . |
| 2108823 | 8/1990 | (JP) . |
| 731664 | 6/1995 | (JP) . |

*Primary Examiner*—Bryon P. Gehman
(74) *Attorney, Agent, or Firm*—Lorusso & Loud

(57) ABSTRACT

A cushioning material for packaging is formed of a foldable and regenerable sheet, such as a corrugated cardboard or thick paper, and is used to protect an article of a rectangular cross-sectional shape packaged in an outer case. First and third frame members (1*a*, 1*c*) for forming a pair of parallel edge members of a rectangular frame, and second and fourth frame members (1*b*, 1*d*) for forming the other pair of parallel edge members of the same frame are provided, and the frame members (1*a*–1*d*) are formed of hollow bodies having a plurality of hollow portions (10) arranged in parallel, the contour and sizes of cross sections intersecting the hollow portions (10) being substantially equal. The hollow bodies constituting the frame members (1*a*–1*d*) are formed in a row by folding corrugated cardboard, thick paper or other foldable sheet, adjacent frame members among frame members (1*a*–1*d*) being connected to outer side sheet portions (11) positioned on the outer side, when the frame members (1*a*–1*d*) are assembled into a rectangular frame, the end portions of adjacent frame members out of the frame members (1*a*–1*d*) having joint structures (16) for combining the frame members together at right angles to each other with the outer side sheet portions (11) left as they are. Therefore, this cushioning material for packaging is rarely deformed, and displays an excellent cushioning effect.

19 Claims, 25 Drawing Sheets

U.S. PATENT DOCUMENTS

| | | | | |
|---|---|---|---|---|
| 5,117,973 | | 6/1992 | Lo Duca . | |
| 5,200,013 | | 4/1993 | Traber . | |
| 5,297,682 | * | 3/1994 | Miltenberger | 206/586 |
| 5,322,168 | * | 6/1994 | Kataoka | 206/588 |
| 5,669,204 | | 9/1997 | Blaisdell . | |
| 5,692,672 | | 12/1997 | Hunt . | |
| 5,709,771 | | 1/1998 | Fritzman . | |
| 5,755,078 | | 5/1998 | Hurtig et al. . | |

* cited by examiner

Fig. 26(a)
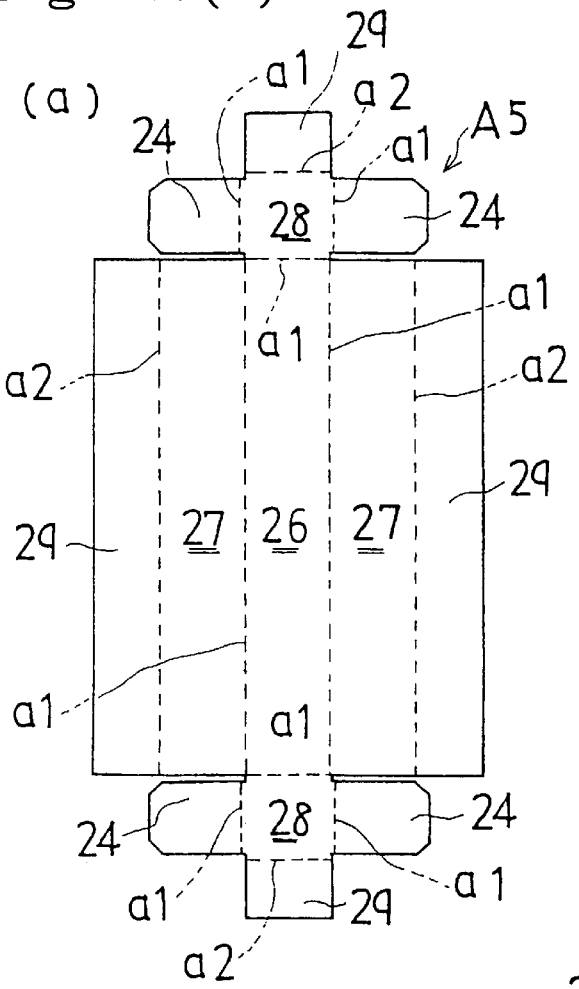
Fig. 26(b)
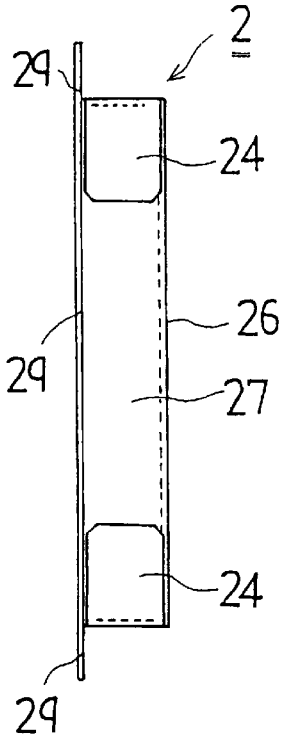
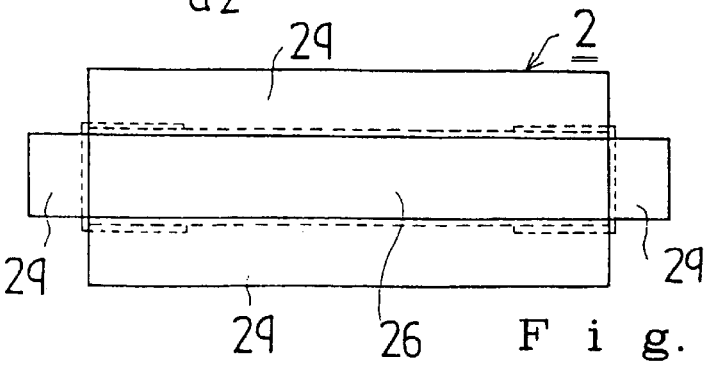
Fig. 26(c)
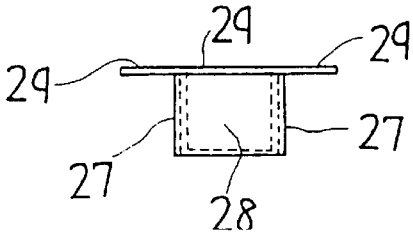
Fig. 26(d)

Fig. 27(a)
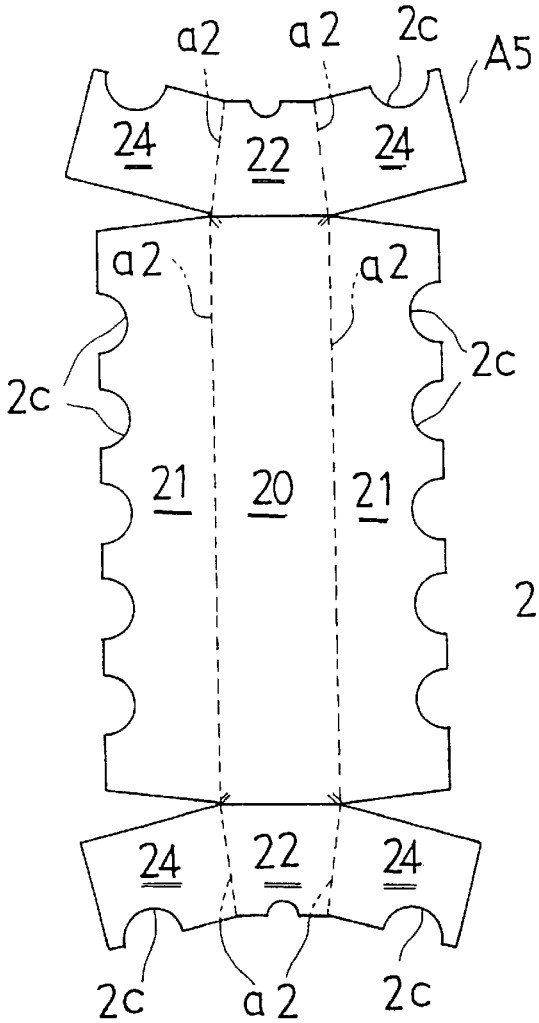
Fig. 27(b)
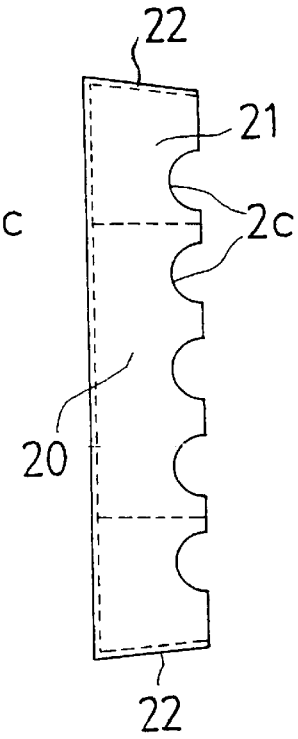
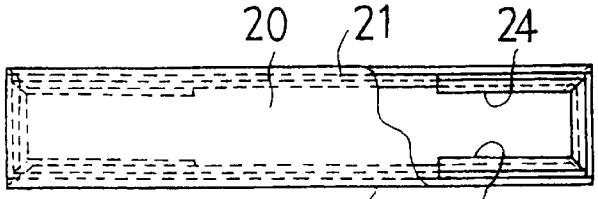
Fig. 27(c)
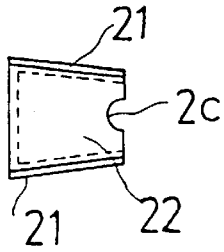
Fig. 27(d)

CUSHIONING MATERIAL FOR PACKAGING

TECHNICAL FIELD

This invention generally relates to a cushioning material for packaging, and more particularly, to a cushioning material for packaging formed of a foldable and recyclable sheet such as a corrugated cardboard, thick paper or the like, and used to protect an article to be packaged when such an article of a rectangular cross-sectional shape is packaged in an outer case.

BACKGROUND ART

In Japanese Patent Laid-open No. 8-58842, for instance, there is proposed a cushioning material for packaging making use of prismatic hollow bodies formed of a corrugated cardboard.

As shown in FIGS. 32 and 33, according to the cushioning material for packaging described in the above publication, the opposite end portions of a hollow body 6 of a square cross-sectional shape have parallel cuts 60, 61 intersecting one edge at a right angle, and an edge portion between the cuts 60, 61 has an incised portion incised in the manner of forming a plurality of symmetrical concave-convex portions 62, 63. In the body 6, two surfaces positioned with the edge between have flaps 66, 67 formed by forming folds 64, 65 to connect the opposite ends of the cuts 60, 61, and a step portion 60*a* is formed as shown in FIG. 33 by turning the flaps 66, 67 inward of the body 6, with the concave-convex portions 62, 63 meshed with one another.

This cushioning material for packaging is used such that the end of an article to be packaged is guided onto the stepped portion 60*a* and is then held therein when packaged in an outer case.

In FIG. 33, step portions 60*a*, 60*a* form a channel by combining a pair of bodies 6, 6 together to position the step portions 60*a* right and left, and the end of an article 4 to be packaged is guided to the inside of the channel formed by portions 60*a*, 60*a* and is then held therein when article 4 is packaged in an outer case (not shown).

Since the cushioning material for packaging proposed in Japanese Patent Laid-open No. 8-58842 described above is mainly formed of the hollow bodies 6, it has low density as a whole, but also has the following problems.

The first problem is that it is difficult to package the article 4 in the outer case together with the cushioning material for packaging, for the reason that the body 6 has only a single hollow of square cross sectional shape, so that each body 6 is easily deformed until constricted by the outer case after packaging the article 4 in the outer case.

The second problem is that only a very lightweight article can be packaged for the reason that the edges of the flaps 67, 67 constituting the bottom of the channel are connected to the flaps 66, 66 constituting the side walls only by meshing the plurality of concave-convex portions 62, 63 with one another, and a leg portion 68 in the center of the bottom of the channel mainly bears the load of the packaged article 4 so that the strength of the bottom flaps 67 is not sufficient when the above cushioning material is used in the state as shown in FIG. 33.

The third problem is that it is difficult to form the concave-convex portions 62, 63 using an automatic machining process after the hollow body 6 is formed in three dimensions. although the folds for forming the hollow body 6, the parallel cuts 60, 60, the concave-convex portions 62, 63 and the folds 64, 65 may be formed simultaneously with the process of cutting the sheet.

DISCLOSURE OF THE INVENTION

An object of the present invention is to provide a cushioning material for packaging, which is wholly formed of a regenerable and foldable sheet, which has a relatively small apparent density, which is easily assembled in a packing process, and besides, is rarely deformed before the assembled cushioning material is packaged in an outer case after an article to be packaged is set in the cushioning material.

Another object of the present invention is to provide a cushioning material for packaging, which is applicable to the packaging of a somewhat heavyweight article.

A further object of the present invention is to provide a cushioning material for packaging, which may be easily assembled using an automatic machine process.

For the purpose of solving the above problems, a cushioning material for packaging according to the present invention is structured as follows.

A cushioning material for packaging according to one embodiment of the present invention comprises first and third frame members forming a pair of parallel edge members of a rectangular or square frame, and second and fourth frame members forming the other pair of parallel edge members of the frame. The frame members are each formed as hollow bodies internally and longitudinally divided into a plurality of hollow sections longitudinally extending in parallel, with the contour and sizes of cross sections of the hollow sections being substantially the same. The hollow frame members constituting the frame members are formed in a row by folding a single sheet of corrugated cardboard, thick paper or other foldable sheet, with adjacent frame members connected by outer side sheet portions positioned on the outer side when the frame members are assembled into a square frame. The ends of some of the frame members are closed by a fold of the sheet to provide joint structures for joining the frame members together at right angles to each other with outer side sheet portions left as they are.

A cushioning material for packaging in a second embodiment of the present invention is characterized in that, in the cushioning material for packaging of the first embodiment of the present invention, the contour of cross sections of the frame members is rectangular or square, and partition sheet portions, inclined to the sides of the cross sections of the frame members, are provided within each hollow portion constituting a frame member.

In another embodiment of cushioning material for packaging the contour of the cross section of the frame members is trapezoidal such that the outer side sheet portions are substantially perpendicular while inner side sheet portions are sharply inclined to the outer side sheet portions and partition sheet portions inclined to the outer side sheet portions are provided within the hollow portions constituting the frame members.

In yet another embodiment, cushioning material for packaging the frame members have the outer side sheet portions which are substantially perpendicular, and are composed of first portions positioned on the outer side when the frame members are assembled into a rectangular or square frame, and second portions coextensive and positioned on the inner side of the first portions and in parallel therewith when the frame members are assembled into the rectangular or square frame, the second portions being substantially equal in height to the first portions.

A cushioning material for packaging according to yet another embodiment of the present invention is in the form of first frame members which are substantially perpendicular when the frame members are assembled into a rectangular or square frame and second frame members coextensive with and abutting inner sides of the first frame members when the frame members are assembled into the rectangular or square frame, the second frame members being shorter in height than the first frame members.

In any of the foregoing embodiments the outer side sheet portions of the frame members may be formed of a plurality of layers formed by folding the sheet into the layers.

A cushioning material for packaging in a further embodiment of the present invention comprises first and third frame members for forming a pair of parallel edge members of a rectangular or square frame, and second and fourth frame members for forming the other pair of parallel edge members, wherein the frame members are formed of layered bodies resulting from folding or laminating a corrugated cardboard, thick paper or other foldable sheet in parallel layers. Adjacent frame members are connected through an outer side sheet portion positioned on the outer side when the frame members are assembled into a rectangular or square frame, and the end portions of adjacent frame members have joint structures for combining the frame members together at right angles to each other with the outer side sheet portion left as is.

Any one of the previously described embodiments of the present invention may include joint structures structured such that the end portion of one of the adjacent frame members is brought into contact with the side surface of the other frame member, or the end portions of the adjacent frame members are brought into contact with each other after these end portions are cut at an angle of about 45 degrees in a rectilinear or zigzag shape with the outer side sheet portion left as is.

In any one of the previously described embodiments of the present invention, either the first frame member or the fourth frame member may have a fixing sheet portion formed by extending its outer side sheet portion for securing to the outer side surface of the other frame member by bonding or other means.

In another embodiment, the first frame member or the fourth frame member is divided into two separate portions and the butted end portions of the divided frame member have joint portions which are connected together by bonding or other fixing means or concavo-convex engagement such that the outer side surface may form a substantially uniform surface when the end portions are butted against each other.

The cushioning material for packaging of the present invention may also comprise first and third frame members for forming a pair of parallel edge members of a rectangular or square frame, second and fourth frame members for forming the other pair of parallel edge members of the frame, a fifth frame member positioned on the inner side of the first frame member, in parallel therewith, a sixth frame member positioned on the inner side of the second frame member in parallel therewith, a seventh frame member positioned on the inner side of the third frame member in parallel therewith, and an eighth frame member positioned on the inner side of the fourth frame member in parallel therewith, wherein the first through eighth frame members are formed of hollow bodies, each having a plurality of hollow portions arranged in parallel along the longitudinal dimension thereof, the contour and sizes of cross sections of the hollow portions being substantially the same. The hollow bodies constituting the frame members are formed linked in a row by folding sections of a corrugated cardboard, thick paper or other foldable sheet, divided by cut-outs, onto an outer side, longitudinally extending sheet portion positioned on the outer side when the frame members are assembled into a rectangular or square frame, and the end portions of adjacent frame members have joint structures for combining the frame members together at right angles to each other with the outer side sheet portion left as is.

A cushioning material for packaging in any one of the foregoing embodiments of the present invention may be formed into a rectangular or square frame and combined with an outer frame of a closed loop shape in contact with the outer side surface of the frame.

An outer side frame may be formed from the cushioning material of the present invention in a rectangular or square shape, and combined with an inner side frame also formed by framing a cushioning material of the present invention into the same shape in contact with the inner side surface of the outer side frame. The inner side frame may be smaller in height than the outer side frame.

A cushioning material for packaging in accordance with the present invention may include a raised bottom member, formed by folding a corrugated cardboard, thick paper or other foldable sheet or folding the same into layers, provided wholly on the inside of the frame or at the inner side portions of the frame members for forming the pair of parallel edge members of the frame.

The raised bottom member provided on the inside of the frame may have leg portions which contact with inner side sheet portions of the frame members for forming at least the pair of edge members of the frame, the raised bottom member being formed by folding a corrugated cardboard, thick paper or other foldable sheet or folding or laminating the same into layers.

Since the frame members have a plurality of longitudinally extending hollow sections, this cushioning material is rarely deformed, and since the plurality of hollow section respectively absorb the shock, this cushioning material displays an excellent cushioning effect. Besides, since the hollow portions of the frame members are arranged in the longitudinal dimension thereof, and the contour and sizes of the cross sections of the frame members are equal to one another,theframemembersmaybeformedtogether,efficiently, when the cushioning material is manufactured by folding the sheet.

Since the frame members are connected together. this cushioning material may be transported or stored without the need for much space, with the connecting portions resulting from the formation of the frame members unfolded, that is, in a semi-folded state.

Since the end portions of the connecting portions of the frame members have joint structures for combining the frame members together at right angles to each other with the outer side sheet portion left as is, it is extremely easy to assemble these frame members into the rectangular or square frame.

Because the other hollow portions are divided by the inclined partitions, the frame members further resist deformation.

In the embodiment wherein the inner side sheet portions of the frame members are sharply inclined, the raised bottom member having side surfaces corresponding to the inclined surfaces of the frame members may be mounted to the frame only by inserting the raised bottom member into the frame when the frame members are assembled into the frame.

According to the embodiment wherein the cushioning material for packaging of the present invention has two parallel frame members forming each side of the frame, collapse of the first and second parallel frame members on one side is less likely to occur at the same time when a shock is received, this cushioning material ensures high shock resistance and displays a more excellent cushioning effect. Further, when the inner frame members are shorter in height than the other frame members, the inner frame members may be used as a raised bottom. Further, a cushioning material with a raised bottom may be manufactured merely by combining frame members together into the shape of a rectangle or square.

In embodiments wherein the fourth frame member has a multilayered fixing sheet portion formed by modifying the outer side sheet portion, the frame may be formed easily and surely at a job site through the process of combining the frame members together in the rectangular or square shape and then fixing the fixing sheet portion to the outer side surface of the adjacent frame member.

In the embodiment wherein the frame is confined by an outer frame in the form of a continuous loop, the frame may be simply assembled without the need for bonding or other fixing means to join the frame members together in a rectangular or square shape.

BRIEF DESCRIPTION OF THE DRAWINGS

FIGS. 26(*a*)–26(*d*) show another embodiment of a raised bottom member of a cushioning material for packaging according to the present invention, wherein FIG. 26(*a*) is a plan view, FIG. 26(*b*) is a front view of the assembled state, FIG. 26(*c*) is a plan view of the assembled state, and FIG. 26(*d*) is a side view of the assembled state;

FIGS. 27(*a*)–27(*d*) show a further embodiment of a raised bottom member, wherein FIG. 27(*a*) is a plan view, FIG. 27(*b*) is a front view of the assembled state, FIG. 27(*c*) is a plan view of the assembled state, and FIG. 27(*d*) is a side view of the assembled state;

DESCRIPTION OF THE PREFERRED EMBODIMENTS

Figure 1:
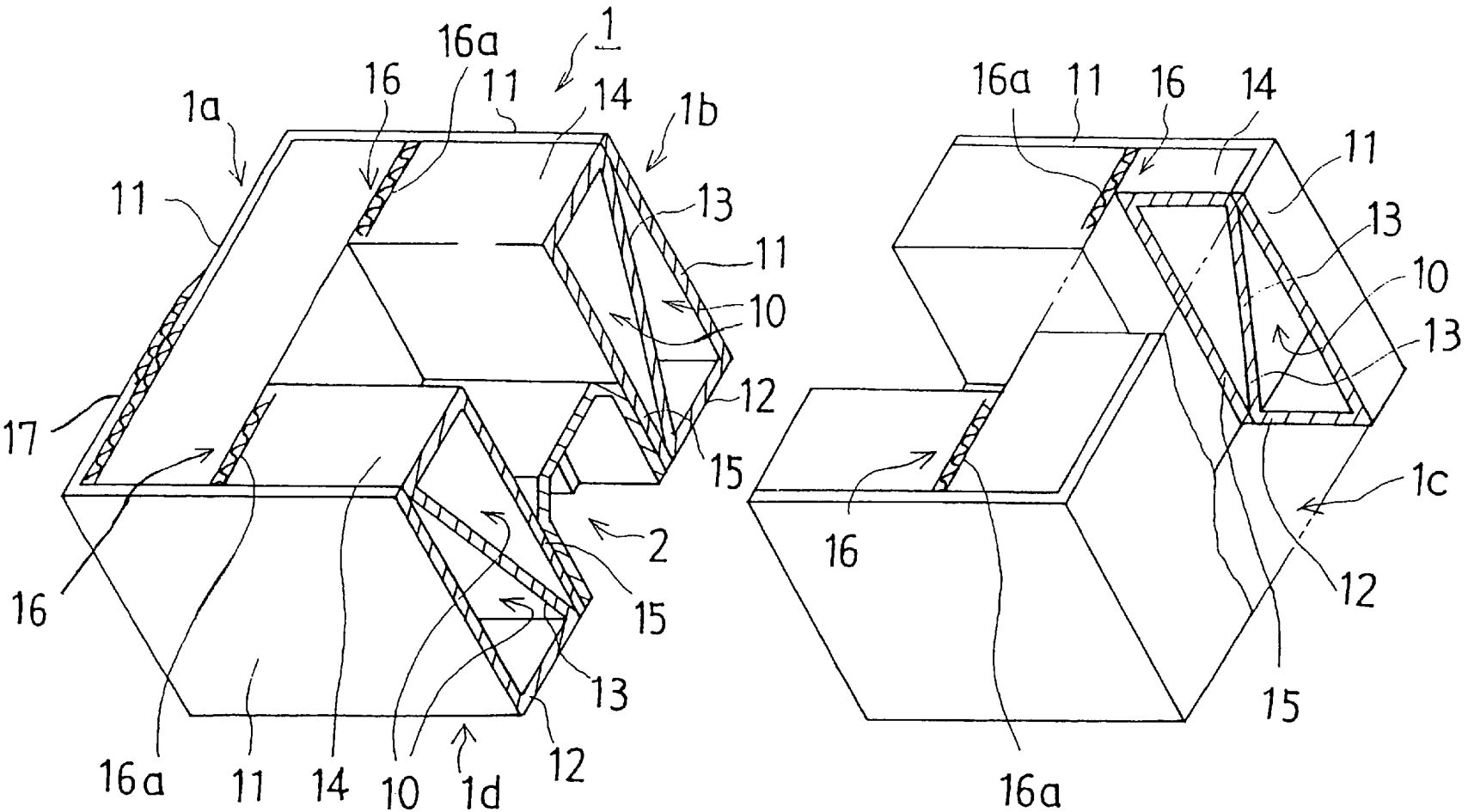
FIG. 1 is a partially broken-away perspective view showing a cushioning material for packaging in the first embodiment according to the present invention.

A description will now be given of preferred embodiments of a cushioning material for packaging according to the present invention with reference to FIGS. 1 to 31.

First Embodiment

As shown in FIGS. 1 to 6 the cushioning material for packaging in the first embodiment comprises first and third frame members 1*a*, 1*c* forming a pair of parallel edge members of a rectangular frame 1, second and fourth frame members 1*b*, 1*d* forming the other pair of parallel edge members of the frame 1 and a raised bottom member 2 inserted on the inside of the frame 1.

The frame members 1*a* to 1*d* respectively have pairs of divided, longitudinally extending hollow portions 10, 10 formed in parallel by folding a foldable sheet A. Sheet A (See FIG. 2), such as a corrugated cardboard, thick paper or the like, is composed of outer side sheet portions 11, bottom sheet portions 12, inclined partition sheet portions 13, top sheet portions 14 parallel to the bottom sheet portions 12 and inner side sheet portions 15 parallel to the outer side sheet portions 11, arranged in parallel along the length of the sheet "A".

Since the hollow portions 10, 10 have a right-angle triangle cross-sectional shape and are arranged in converse positions, and the sizes of cross-sections of these hollow portions are equal to each other, the contour and sizes of cross sections of the frame members 1*a* to 1*d* are also equal to one another.

The adjacent frame members among frame members 1*a* to 1*d* are connected to the outer side sheet portions 11 positioned on the outer side when the frame members 1*a* to 1*d* are assembled into the rectangular frame 1, as shown in FIG. 1.

The end portions of the adjacent frame members among the frame members 1*a* to 1*d* have joint structures 16 for combining the frame members 1*a* to 1*d* together at right angles to each other with the outer side sheet portions 11 left as they are.

The joint structures 16 in the first embodiment are formed as end portions of the second and fourth frame members 1*b*, 1*d*, separate and distinct from the outer side sheet portions 11, and are brought into contact with the inner side surfaces of the first and third frame members 1*a*, 1*c*. In portions of the joint structures 16, the opposite end portions of the second and fourth frame members 1*b*, 1*d* have overlap-width flaps 16*a* formed by extending the inner side sheet portions 15 in order to facilitate the bonding of the end surfaces of the second and fourth frame members to the inner side surfaces of the first and third frame members 1*a*, 1*c*.

The end portion of the fourth frame member 1*d* on the side of the first frame member 1*a* has a fixing sheet portion 17, formed by extending the end portion of the outer side sheet portion 11, so that the frame 1 surely holds its shape when the frame members 1*a* to 1*d* are assembled into the rectangular frame 1, and this fixing sheet portion 17 is fixed to the outer side surface of the first frame member 1*a* by bonding, stapling or other means.

Figure 2:
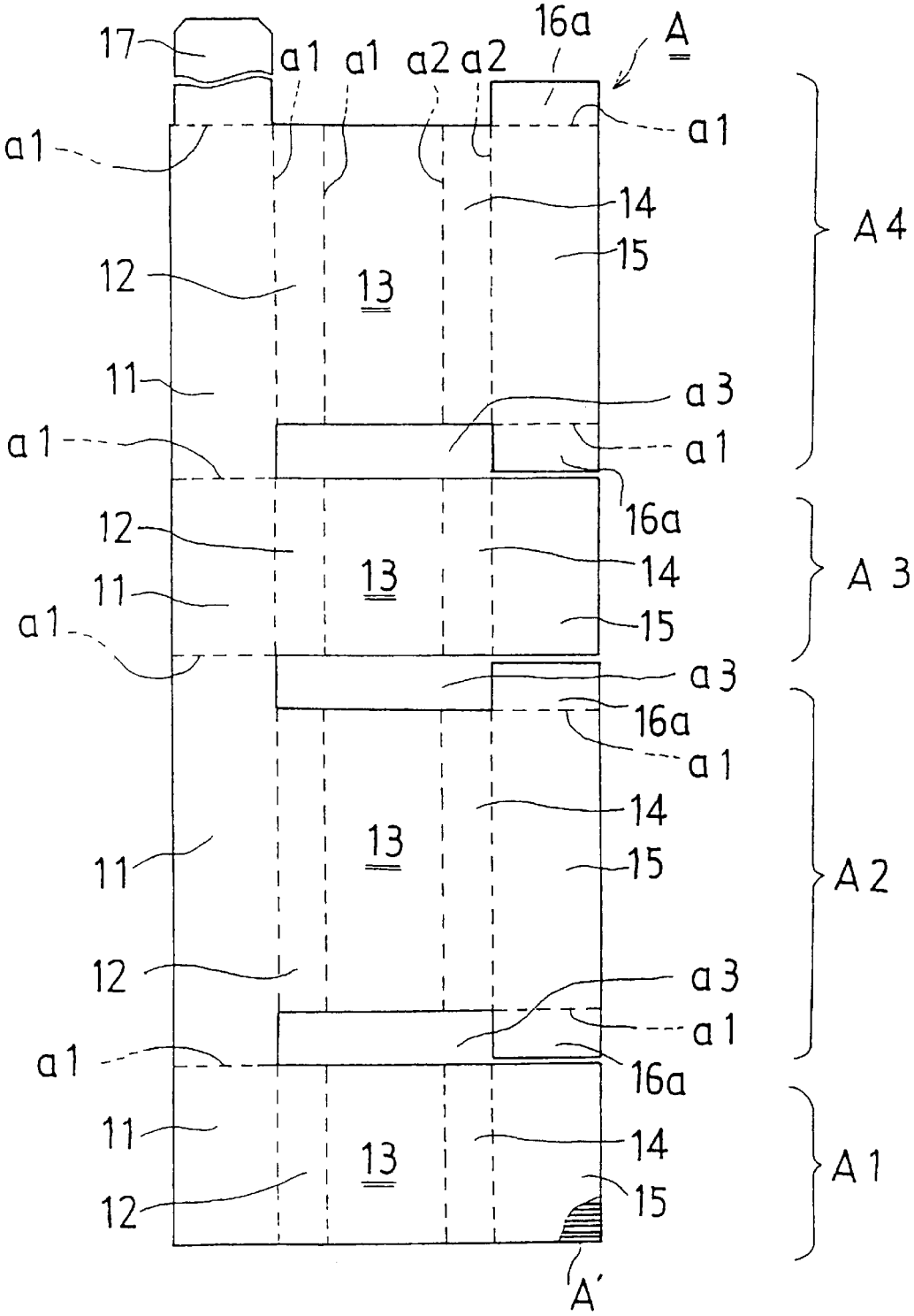
FIG. 2 is a plan view of the sheet from which the cushioning material for packaging of FIG. 1 is formed.

All of the frame members 1*a* to 1*d* are made from the single sheet A formed of a piece of corrugated cardboard cut as shown in FIG. 2.

The sheet A cut as shown in FIG. 2 has a first frame member forming portion A1, a second frame member forming portion A2, a third frame member forming portion A3 and a fourth frame member forming portion A4 which are formed in this order from the lower end toward the upper end in FIG. 2.

Each of the frame member forming portions A1 to A4 respectively has the outer side sheet portion 11, the V-shaped fold a1 folded in the shape of a letter Y the bottom sheet portion 12, the V-shaped fold a2, the partition sheet portion 13, the inverse V-shaped fold a1 folded in the inverse shape of a letter V the top sheet portion 14, the inverse V-shaped fold a2 and the inner side sheet portion 15 which are formed in order from one side portion. Flutes A' of the sheet A formed of the corrugated cardboard are arranged transverse to the longitudinal dimension of sheet A and to the longest dimensions of outer side sheet portions 11, the partition sheet portions 13 and the inner side sheet portions 15.

The inner end portion of the outer side sheet portion 11 in the first frame member forming portion A1 and the opposite end portions of the outer side sheet portion 11 in the third frame member forming portion A3 respectively have the V-shaped folds a1, and the outer end portion of the outer side sheet portion 11 in the fourth frame member forming portion A4 has the fixing sheet portion 17 formed through the V-shaped fold a1.

The opposite end portions of the inner side sheet portions 15, 15 in the second and fourth frame member forming portions A2, A4 respectively have the flaps 16*a* connected through the V-shaped folds a1.

A portion between the bottom sheet portions 12, that between the partition sheet portions 13 and that between the top sheet portions 14 respectively have cutouts a3 which allow forming the joint structures 16 in FIG. 1.

Figure 3:
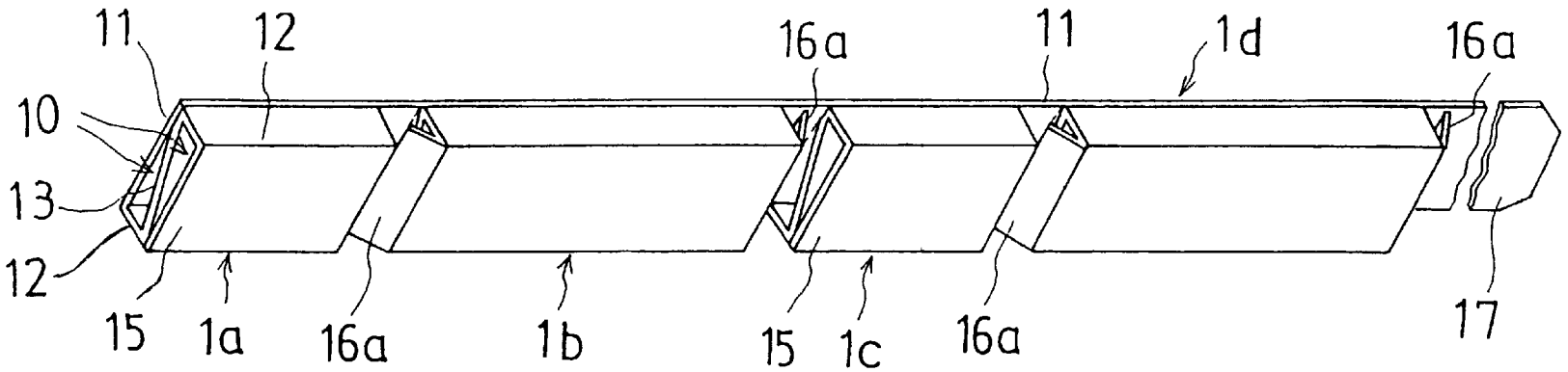
FIG. 3 is a schematic perspective view showing the cushioning material for packaging of FIG. 1 in the course of assembling.

The sheet A is provided with a folding directional tendency along the folds a1, a2, and the frame members 1*a* to 1*d* may be assembled by folding the sheet portions along the folds a1, a2 as shown in FIG. 3 after the required sheet portions are spread with paste.

After the cushioning material for packaging formed of the frame members 1*a* to 1*d* in FIG. 3 is transported from a manufacturer to a place requested by a user in a semi-folded state, wherein only the frame members 1*a* to 1*d* are formed in three dimensions, these frame members are assembled into the frame 1 in three dimensions as shown in FIG. 1 at the job site to pack an article 4 which will be described later.

The frame members in the state of FIG. 3 are assembled into the frame as shown in FIG. 1 in three dimensions through the process of folding the portions between the frame members 1*a* to 1*d* at right angles to one another along the V-shaped folds a1 formed in portions of the outer side sheet portions 11 shown in FIG. 2, and then bonding the flaps 16*a* to the opposite end portions of the inner side sheet portions 15 of the frame members 1*a*, 1*c*. Then, the fixing sheet portion 17 is folded toward the outer side sheet portion 11 of the first frame member a1, and is then fixed to the outer side surface of the first frame member 1*a* by bonding or other means.

Figure 5:
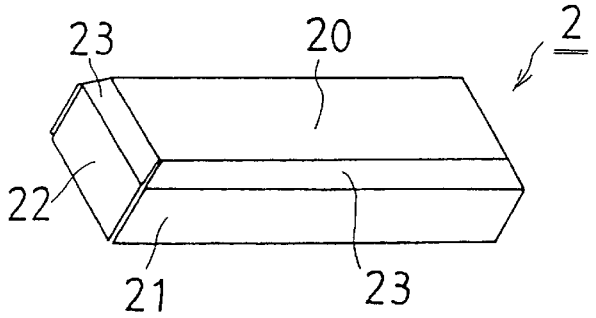
FIG. 5 is a perspective view showing the raised bottom member assembled from the unfolded state of FIG. 4, as viewed from the top.
Figure 6:
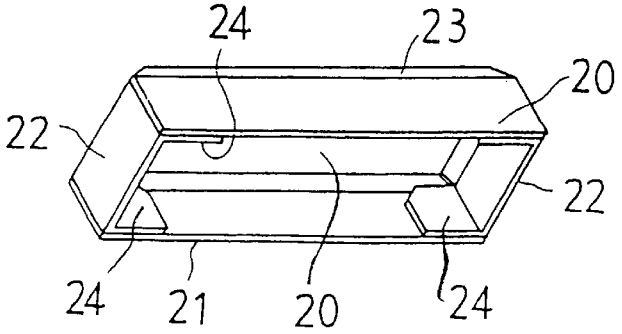
FIG. 6 is a perspective view showing the assembled raised bottom member, as viewed from the bottom.

As shown in FIGS. 5 and 6, the raised bottom member 2 has a top sheet portion 20, side leg portions 21, 21 depending from the opposite sides of the top sheet portion 20, and end leg portions 22, 22 formed depending from the opposite ends of the top sheet portion 21, and the edges of the four peripheral sides of the top sheet portion 20 respectively have chamfered (inclined) portions 23.

Figure 4:
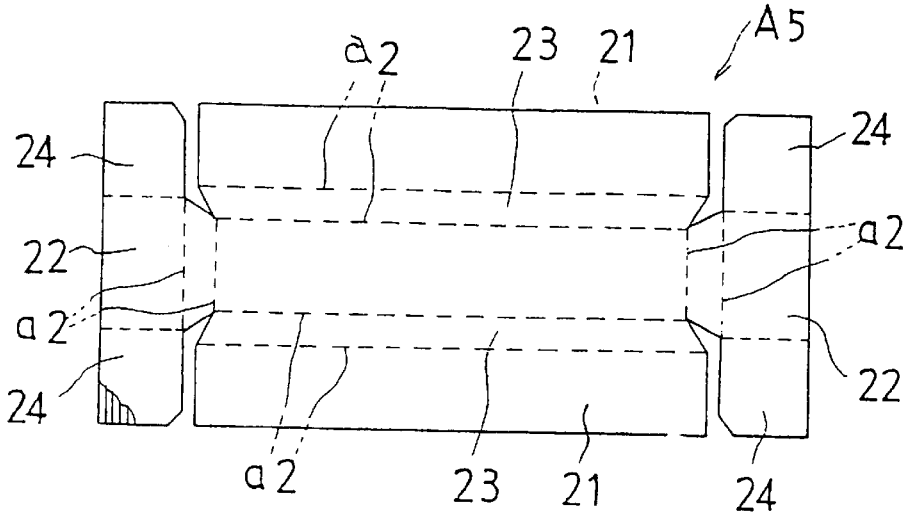
FIG. 4 is a plan view of the raised bottom member in the cushioning material for packaging of FIG. 1.

The raised bottom member 2 having the above structure is made from a sheet A5 formed of a corrugated cardboard cut as shown in FIG. 4.

In the sheet A5 cut in a substantially rectangular shape, the opposite sides of the top sheet portion 20 in the center have the inclined portions 23 and the side leg portions 21 respectively formed in order through the inverse V-shaped folds a2, a2. The opposite end portions of the top sheet portion 20 have the inclined portions 23 and the end leg portions 22 respectively formed in order through the inverse V-shaped folds a2 , a2, and the opposite sides of the end leg portions 22 have the flaps 24, 24 respectively formed, also for reinforcement, through the inverse V-shaped folds a2.

The raised bottom member 2 as shown in FIGS. 5 and 6 is manufactured by the process of folding the sheet A5 cut as shown in FIG. 4 along the portions of the folds a2 in an inverse V-shape and then bonding the sheet portions of the flaps 24 to the opposite end inner surfaces of the side leg portions 21.

The raised bottom member 2 is inserted into the frame 1 formed of the frame members 1*a* to 1*d* and is then bonded to the inner side sheet portions 15.

Figure 7:
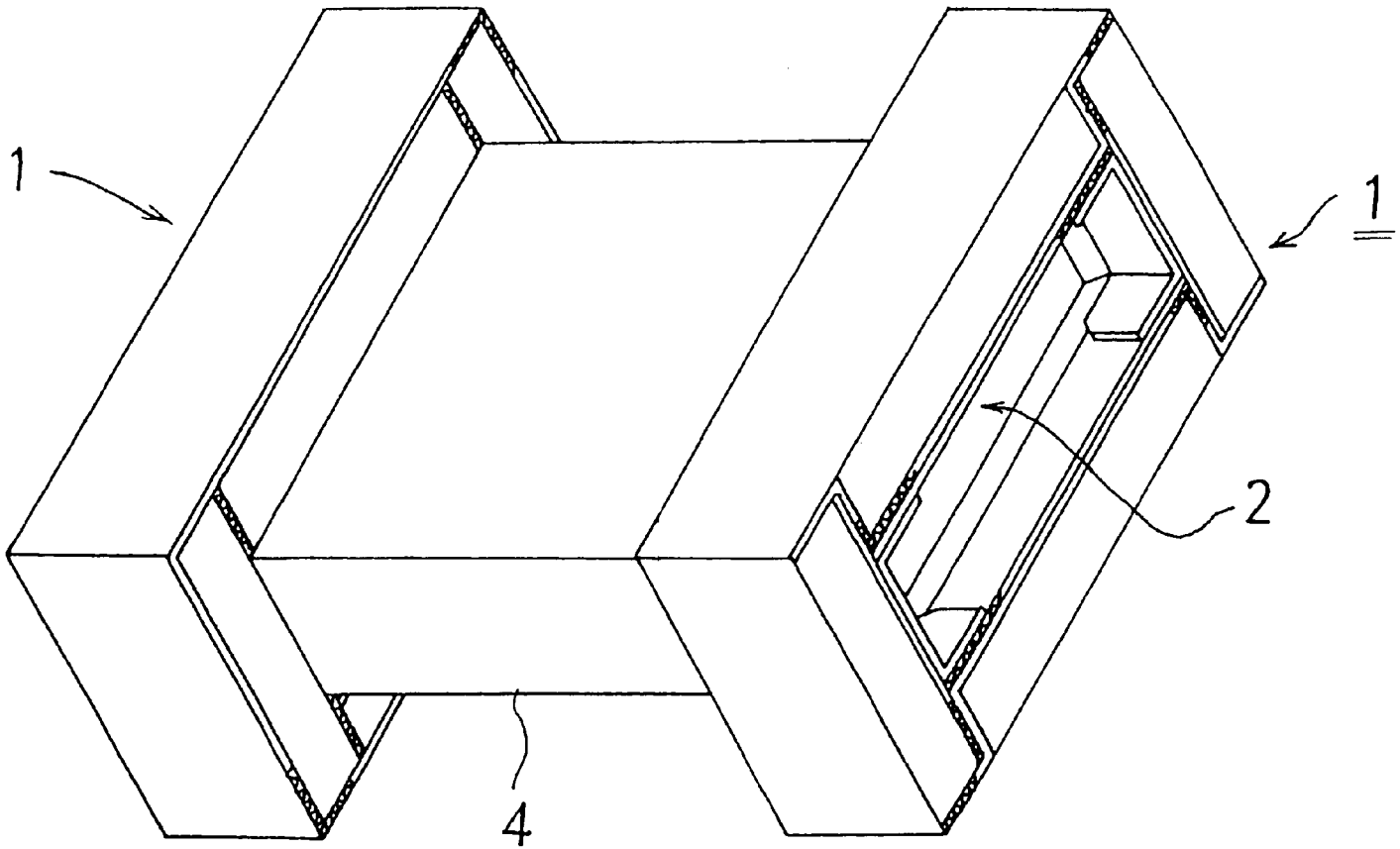
FIG. 7 is a perspective view showing the use of the cushioning material for packaging according to the first embodiment.

The cushioning material for packaging in the first embodiment of FIG. 1 is used to protect the article 4 to be packaged from the shock when a relatively small-sized article 4 of a rectangular parallelepiped shape, such as a personal computer or an image scanner as shown in FIG. 7, for instance, is packaged in an outer case (not shown), with the end of such an article inserted into the frame 1 to hold the article therein.

According to the cushioning material for packaging in the first embodiment, since the frame members 1*a* to 1*d* have the plurality of hollow portions 10, 10 respectively partitioned through the inclined partition sheet portions 13, this cushioning material is rarely deformed and may protect even a somewhat heavyweight article to be packaged.

When a shock is received, the hollow portions 10 of any of the frame members 1*a* to 1*d* are deformed depending on the direction of the external force, resulting in efficient absorption of the shock. Since the frame members 1*a* to 1*d* have the plurality of hollow portions 10, the collapse of the plurality of hollow portions 10 is less likely to occur all at once even when a great shock is received, and one hollow portion 10 is frequently left as is, so that an article to be packaged may be protected more efficiently.

According to the cushioning material for packaging formed of the frame members 1*a* to 1*d*, since the hollow portions 10, 10 of the frame members 1*a* to 1*d* are arranged in the same direction, and the contour and sizes of the cross sections of these frame members are equal to one another, this cushioning material may be manufactured at low cost through an automatic machine process.

The cushioning material for packaging in the first embodiment as shown in FIG. 3 may be transported or stored in the semi-folded state as shown in FIG. 3 wherein it is not bulky, and hence, is convenient to use.

Incidentally, when the cushioning material for packaging in the first embodiment is used with an end of the packaged article 4 projecting from the frame 1, there is no need to install the raised bottom member 2. In this case. the cushioning material for packaging is an embodiment providing only the frame 1.

Second Embodiment

Figure 8:
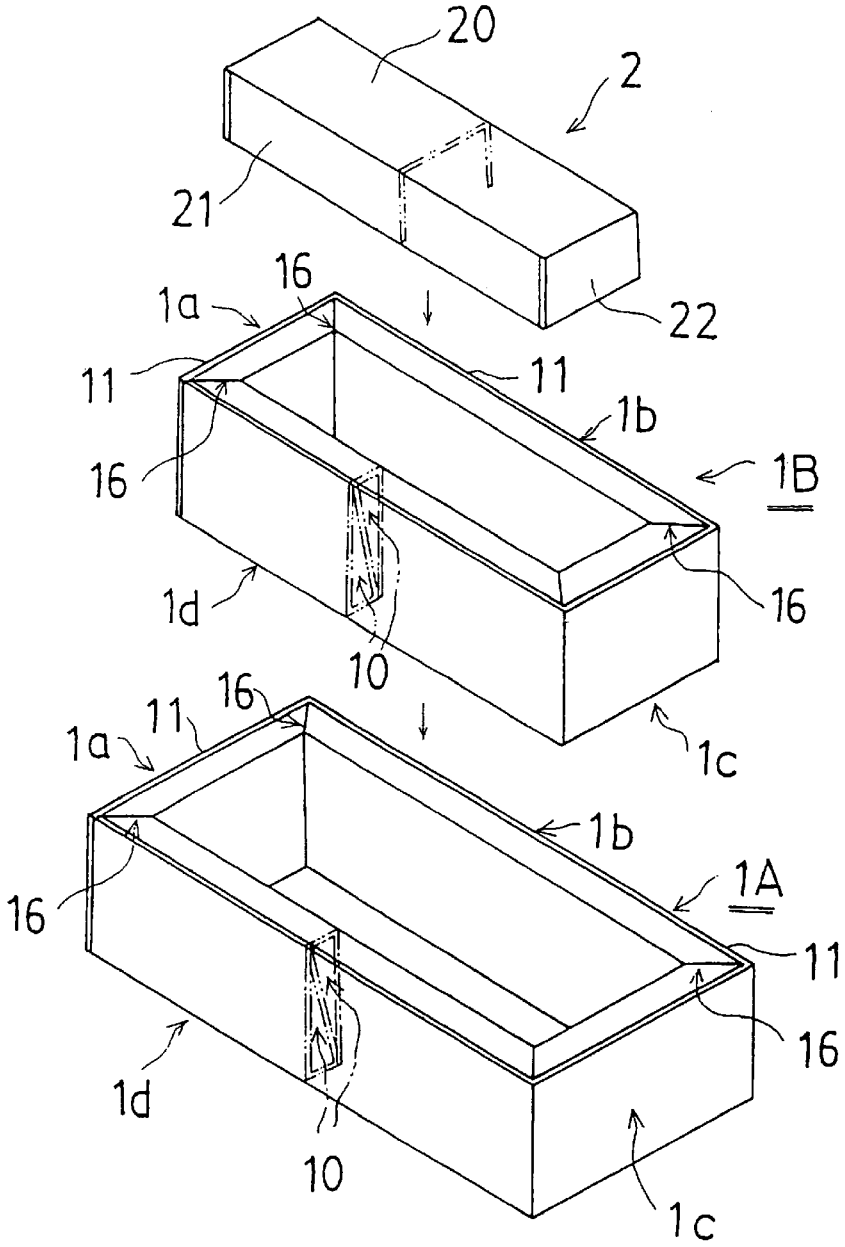
FIG. 8 is an exploded perspective view showing a cushioning material for packaging in the second embodiment according to the present invention.
Figure 9:
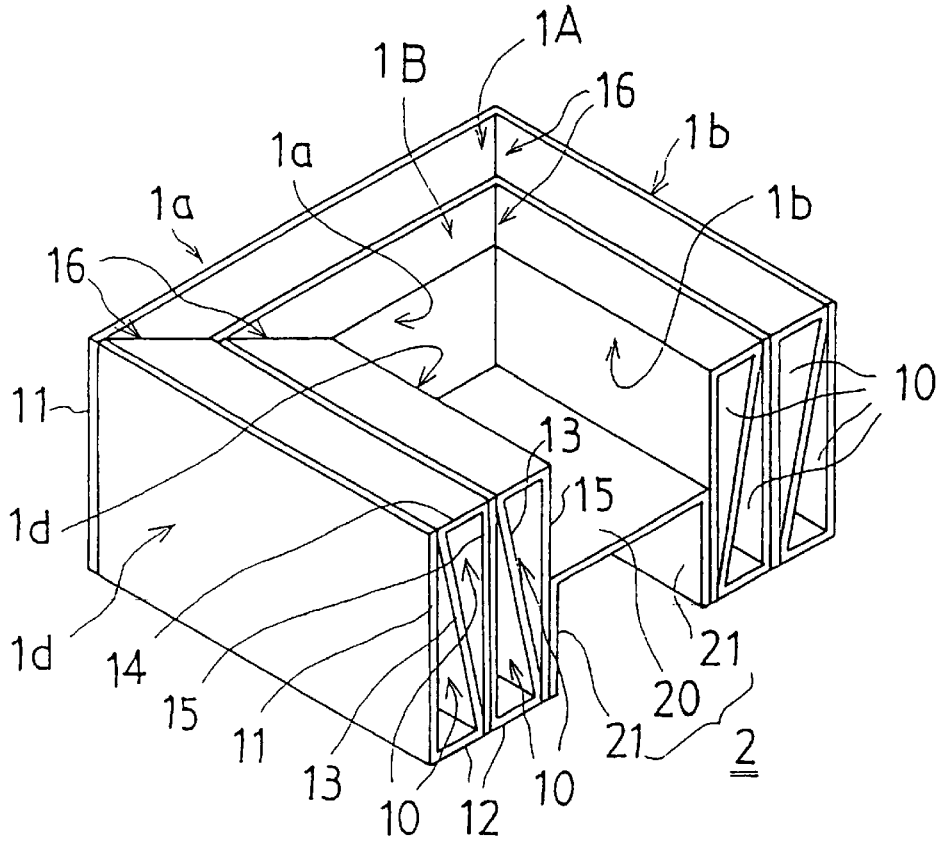
FIG. 9 is a perspective view, partially in cross-section, showing the assembled state of the cushioning material for packaging of FIG. 8.
Figure 10:
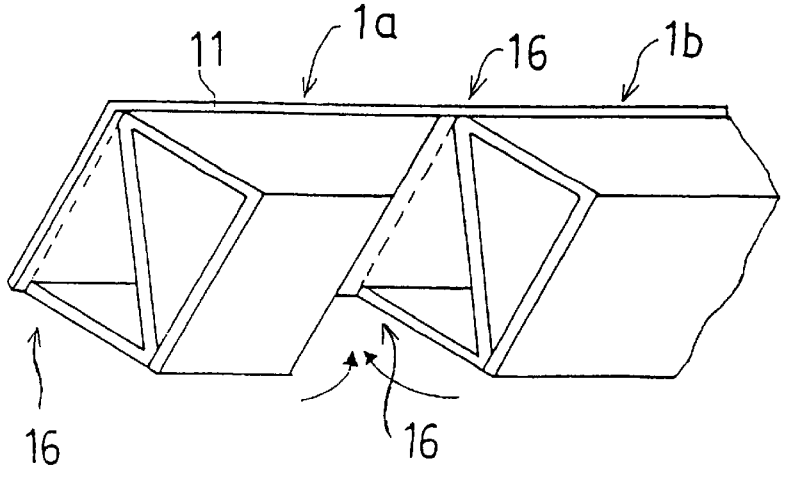
FIG. 10 is a partial, enlarged perspective view showing joint structures of the cushioning material for packaging of FIG. 8.

FIGS. 8 to 10 show a second embodiment a cushioning material for packaging in a second embodiment of the invention.

Referring to FIG. 8, reference numeral 1A denotes an outer side frame. and 1B is an inner side frame inserted into the outer side frame 1A so as to make contact with the inner side surface of the outer side frame.

The outer side frame 1A and the inner side frame 1B have the same structure, except that their sizes are different from each other, and each of the outer and inner side frames is formed by three-dimensionally combining first to fourth frame members 1*a* to 1*d*, of similar sectional shape to the frame members of the frame 1 in the first embodiment, together into a rectangular shape.

The adjacent frame members in each of the outer side frame 1A and the inner side frame 1B are respectively connected together through outer side sheet portions 11. The end portions of the adjacent frame members 1*a*, 1*b*, those of the adjacent frame members 1*b*, 1*c*, those of the adjacent frame members 1*c*, 1*d* and those of the adjacent frame members 1*d*, 1*a* have joint structures 16 wherein end portions are cut at an angle of about 45 degrees in a rectilinear shape with the outer side sheet portions 11 left as they are in order to combine the frame members together at right angles to each other.

A raised bottom member 2 is inserted into the inner side frame 1B. The raised bottom member 2 has a top sheet portion 20, side leg portions 21, 21 formed below the opposite sides of the top sheet portion 20 and end leg portions 22, 22 formed below the opposite ends of the top sheet portion 20.

According to the cushioning material for packaging in the second embodiment, since the outer side frame 1A and the inner side frame 1B are combined together into a double frame, so that the collapse of the outer side frame 1A and the inner side frame 1B is remarkably less likely to occur at the same time, even when receiving a great force, this cushioning material displays an excellent shock resisting effect.

Other structure, operation and effects of the cushioning material for packaging in the second embodiment are similar to those of the cushioning material for packaging in the first embodiment, and hence, the description thereof will be omitted.

Third Embodiment

Figure 11:
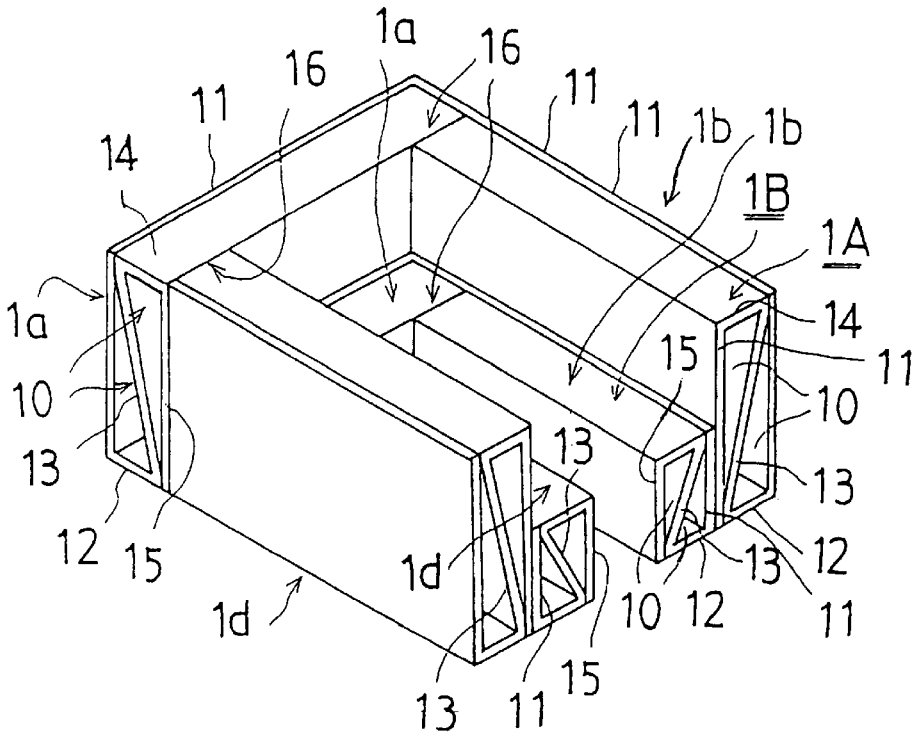
FIG. 11 is a partial perspective view showing a cushioning material for packaging in the third embodiment according to the present invention.

FIG. 11 shows a cushioning material for packaging in a third embodiment which is similar to the cushioning material for packaging in the second embodiment in that the cushioning material is composed of an outer side frame 1A formed of frame members 1*a* to 1*d* having substantially the same structure as those of the cushioning material in the first embodiment and an inner side frame 1B having a structure similar to the outer side frame and inserted into the outer side frame, except that the inner side frame 1B is shorter in height than the outer side frame 1A and thereby differs from the cushioning material in the second embodiment. Joint structures 16 at the end portions of the adjacent frame members 1*a* to 1*d* are substantially similar in structure to those of the cushioning material for packaging in the first embodiment.

According to the cushioning material for packaging in the third embodiment, since the inner side frame 1B also serves as the raised bottom member, it is possible to use this cushioning material in the manner as shown in FIG. 7 without providing an additional raised bottom member. In the third embodiment as described above, since the cushioning material including the raised bottom for packaging is wholly formed of a single sheet, the manufacturing process is further simplified, resulting in a further reduction in manufacturing cost.

Other structure, operation and effects of the cushioning material in the third embodiment are similar to those of the cushioning material for packaging in the second embodiment, and hence, the description thereof will be omitted.

Figure 12:
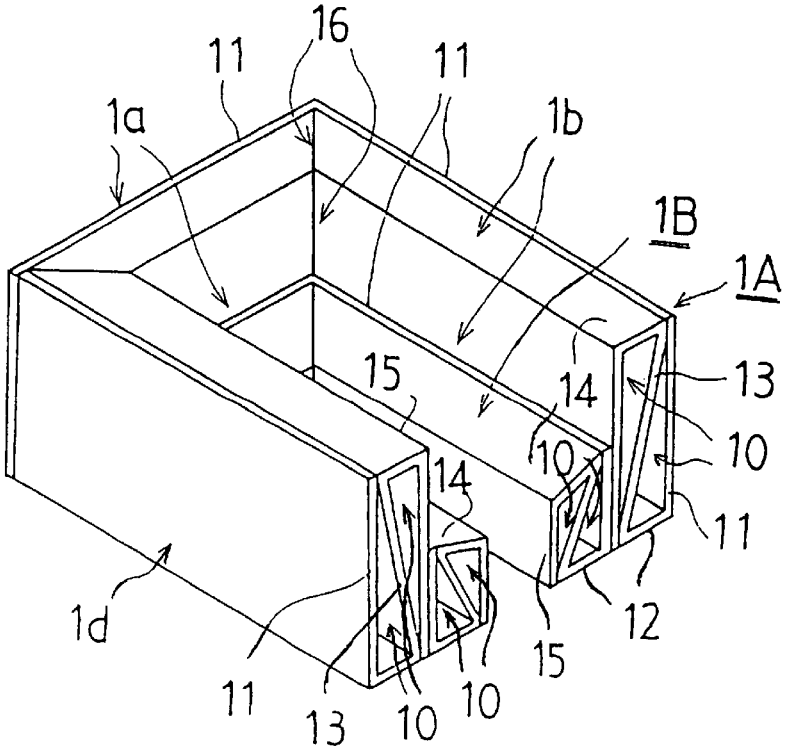
FIG. 12 is a partial perspective view showing a cushioning material for packaging in the fourth embodiment according to the present invention.

Fourth Embodiment FIG. 12 shows a cushioning material for packaging in a fourth embodiment which is substantially similar to the cushioning material for packaging in the third embodiment in that the cushioning material is composed of an outer side frame 1A formed by combining frame members 1*a* to 1*d* together in a rectangular shape and an inner side frame 1B formed by combining the frame members la to 1*d* together in a rectangular shape and inserted into the outer side frame 1A. The inner side frame 1B is shorter in height than the outer side frame 1A, except that top sheet portions 14 of the frame members 1*a* to 1*d* in the inner side frame 1B are inclined downward toward the inner side, and thereby differs from the cushioning material in the third embodiment.

According to the fourth embodiment, since the top sheet portions 14 of the frame members 1*a* to 1*d* in the inner side frame 1B are inclined downward toward the inner side, while the inner side frame 1B also serves as the raised bottom member 2, this cushioning material is effectively used when the end of an article to be packaged (not shown) has an inclined shape corresponding to the inclination of the top sheet portions 14.

Fifth Embodiment

Figure 13:
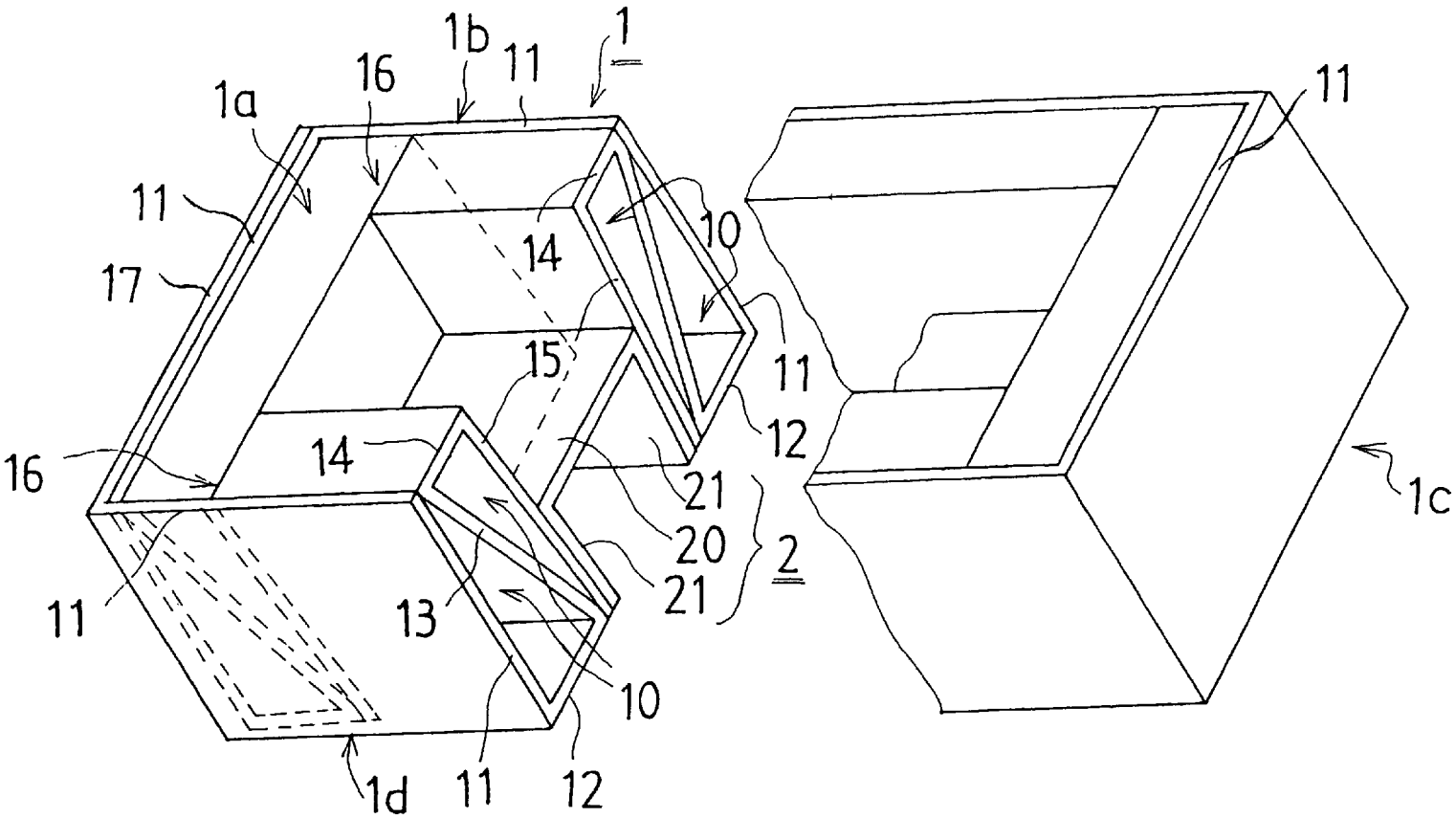
FIG. 13 is a partially broken-away perspective view showing a cushioning material for packaging in the fifth embodiment according to the present invention.

FIG. 13 shows a fifth embodiment which comprises a rectangular frame 1 formed of first to fourth frame members 1*a* to 1*d* connected together through portions of outer side sheet portions 11 and a raised bottom member 2 inserted into the frame 1.

The contour of cross sections of the frame members 1*a* to 1*d* is trapezoidal, and hence, inner side sheet portions 15 of these frame members are sharply inclined to the perpendicular outer side sheet portions 11 such that top sheet portions 14 are made narrower than bottom sheet portions 12. Leg portions 21, 22 of the raised bottom member 2 are formed in parallel to the inclination of the inner side sheet portions 15 of the frame members 1*a* to 1*d*.

According to the cushioning material for packaging in the fifth embodiment, the horizontally rectangular frame 1 has the sharply inclined inner wall surfaces, so that when the raised bottom member 2 is formed in conformity to the inclination of the inner wall surfaces, it becomes possible to prevent the raised bottom member 2 from slipping off from the frame 1 only by inserting the raised bottom member into the frame 1. Thus, since there is no need to fix the raised bottom member 2 to the inner wall surfaces of the frame 1 by bonding or other means, the manufacturing process is further simplified.

Other structure, operation and effects of the cushioning material for packaging in the fifth embodiment are substantially similar to those of the cushioning material for packaging in the first embodiment, and hence, the description thereof will be omitted.

Sixth Embodiment

Figure 14:
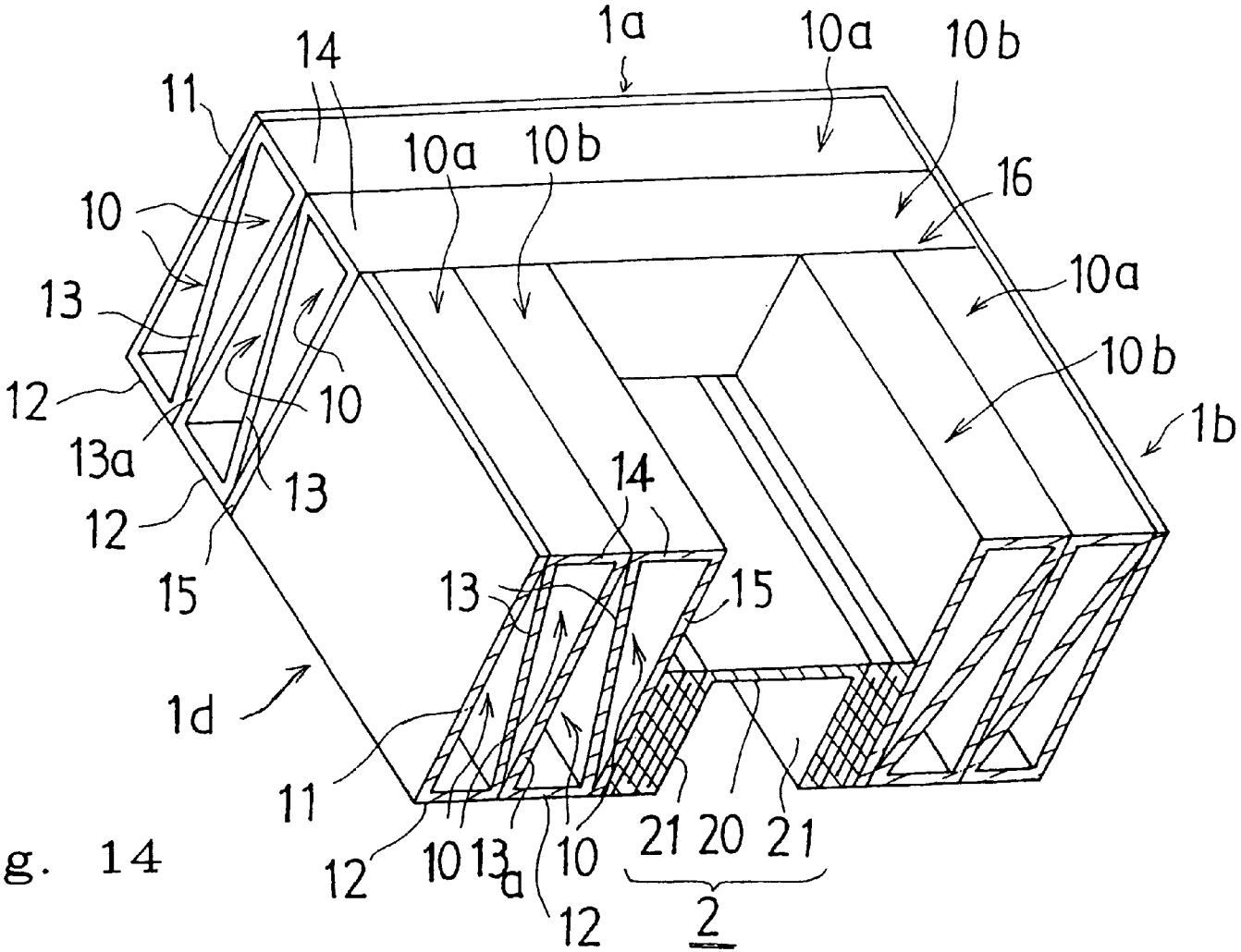
FIG. 14 is a partial perspective view showing a cushioning material for packaging in the sixth embodiment according to the present invention.

FIG. 14 shows a cushioning material for packaging in a sixth embodiment which, like the previously described embodiments, is a rectangular frame 1 formed of frame members 1*a* to 1*d* and a raised bottom member 2 inserted in the interior side of the frame 1.

The frame members 1*a* to 1*d* have four hollow portions of a right-angle triangular cross-sectional shape having the same size in cross section and arranged in alternately converse positions, and are composed of first portions 10*a* positioned on the outer side when the frame members are combined together in a rectangular shape as shown in FIG. 14 and second portions 10*b* continuously positioned on the inner side of the first portions 10*a* in parallel, and the first portions 10*a* are equal in height to the second portions 10*b*.

Each first portion 10*a* has an outer side sheet portion 11, a bottom sheet portion 12, a partition sheet portion 13, a top sheet portion 14 and a perpendicular partition sheet portion 13*a*. On the other hand, each second portion 10*b* has a perpendicular partition wall 13*a* shared with the first portion 10*b*, a bottom sheet portion 12, an inclined partition sheet portion 13, a top sheet portion 14 and an inner side sheet portion 15.

The raised bottom member 2 has a substantially horizontal top sheet portion 20, side leg portions 21, 21 formed depending perpendicular from the opposite sides of the top sheet portion, and the side leg portions 21, 21 are formed of a plurality of layers resulting from folding required portions of the material sheet in layers.

According to the cushioning material for packaging in the sixth embodiment, collapse of the first and second portions 10*a*, 10*b* is less likely to occur all at once even when a great shock is received, and this cushioning material displays a high cushioning effect. Further, since the raised bottom member 2 is reinforced with the side leg portions 21 formed of the plurality of layers, a high cushioning effect is also displayed by the raised bottom member 2.

Other structure, operation and effects of the cushioning material in the sixth embodiment are substantially similar to those of the cushioning material in the first embodiment, and hence, the description thereof will be omitted.

Seventh Embodiment

Figure 15:
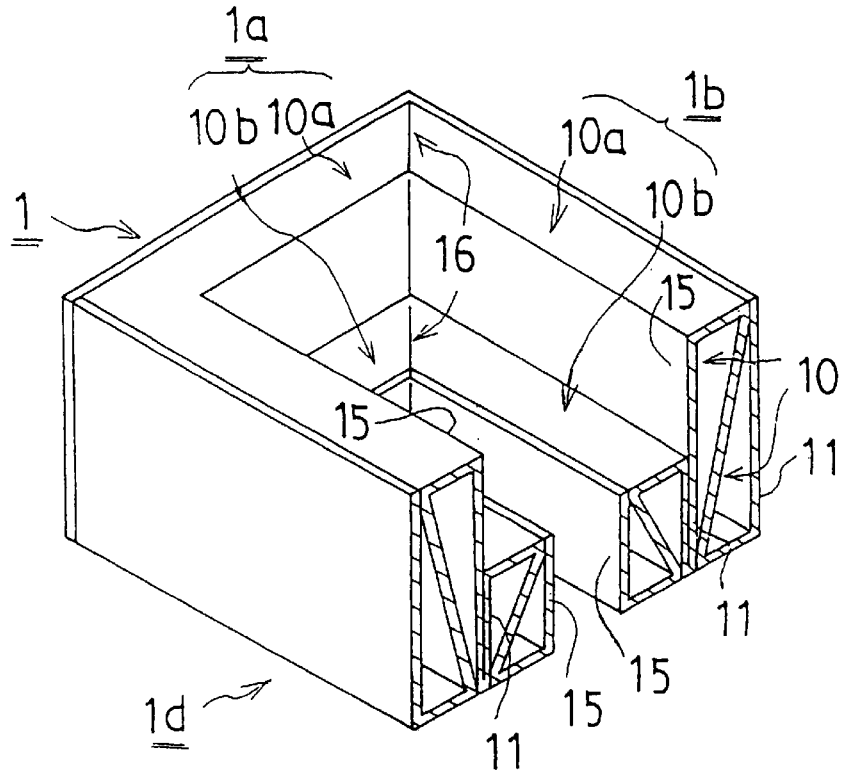
FIG. 15 is a partial perspective view showing a cushioning material for packaging in the seventh embodiment according to the present invention.

FIG. 15 shows a cushioning material for packaging in a seventh embodiment of the invention wherein frame members 1*a* to 1*d* are similar to the frame members 1*a* to 1*d* of the cushioning material for packaging in the sixth embodiment in that the frame members 1*a* to 1*d* are composed of first portions 10*a* positioned on the outer side when the frame members are combined together in a rectangular shape and second portions 10*b* continuously positioned on the inner side of the first portions in parallel.

However, the frame members in the seventh embodiment are different from the frame members of the cushioning material in the sixth embodiment in that the second portions 10*b* of the frame members 1*a* to 1*d* of the cushioning material in the seventh embodiment are shorter in height than the first portions 10*a*, and in that the first portions 10*a* have inner side sheet portions 15, while the second portions 10*b* have outer side sheet portions 11.

Further, the cushioning material for packaging in the seventh embodiment has no raised bottom member, for the reason that the second portions 10*b* positioned on the inner side of the frame 1 are shorter in height than the first portions 10*a* so that the second portions 10*b* fulfill the functions of the raised bottom member.

In the frame members 1*a* to 1*d* of the cushioning material for packaging in the seventh embodiment, since the partition walls 13 are shared by the first and second portions 10*a*, 10*b* in a manner different from the sixth embodiment, the first and second portions are thereby strengthened. Further, since the second portions 10*b* of the frame members 1*a* to 1*d* have a short height so that the frame 1 having a raised bottom may be formed of only the first to fourth frame members 1*a* to 1*d* without the need for the raised bottom member, the manufacturing process is simplified, resulting in a further reduction in manufacturing cost.

Other structure, operation and effects of the cushioning material for packaging in the seventh embodiment are substantially similar to those of the cushioning material in the sixth embodiment, and hence, the description thereof will be omitted.

Incidentally, the cushioning material for packaging in the sixth embodiment may also be formed similar to the cushioning material in the seventh embodiment such that the outer side sheet portions 11 of the second portions 10*b* of the frame members 1*a* to 1*d* are positioned continuously on the lower ends of the inner side sheet portions of the first portions 10*a* thereof.

Eighth Embodiment

Figure 16:
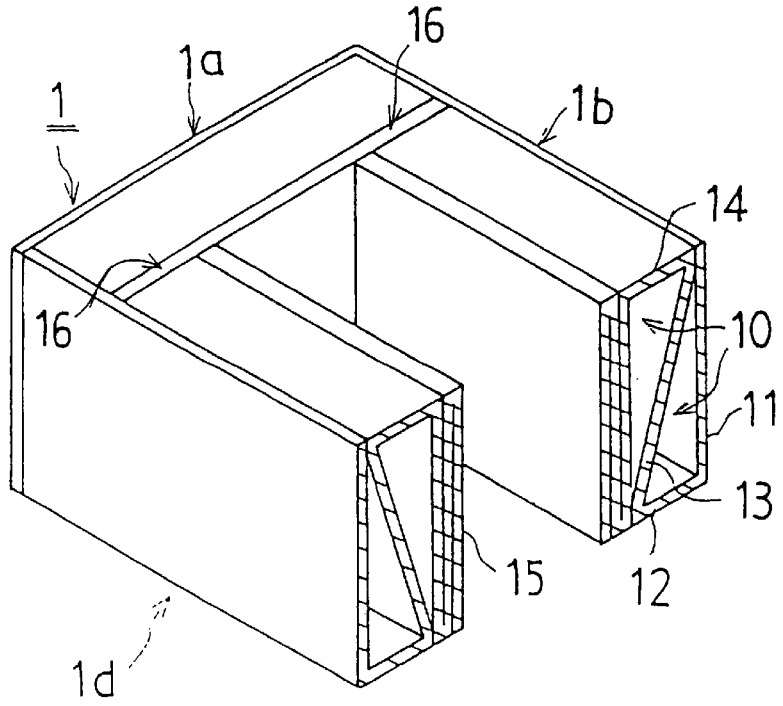
FIG. 16 is a partial perspective view showing a cushioning material for packaging in the eighth embodiment according to the present invention.

FIG. 16 shows a cushioning material for packaging in an eighth embodiment of the invention wherein inner side sheet portions 15 of frame members 1*a* to 1*d* are formed of a plurality of layers resulting from folding required portions of the sheet into layers. Since the frame 1 has the inner side wall surfaces formed of the plurality of layers as described above, the inner side wall portions are strengthened and display a higher cushioning effect.

The cushioning material in the eighth embodiment may be used not only as shown in FIG. 16 to package an article such that the end of such an article projects from one side of the frame 1 to the other side, but also as shown in FIG. 7 by mounting the raised bottom member (not shown) inside of the frame 1.

Other structure, operation and effects of the cushioning material in the eighth embodiment are substantially similar to those of the cushioning material for packaging in the first embodiment, and hence, the description thereof will be omitted.

Ninth Embodiment

Figure 17:
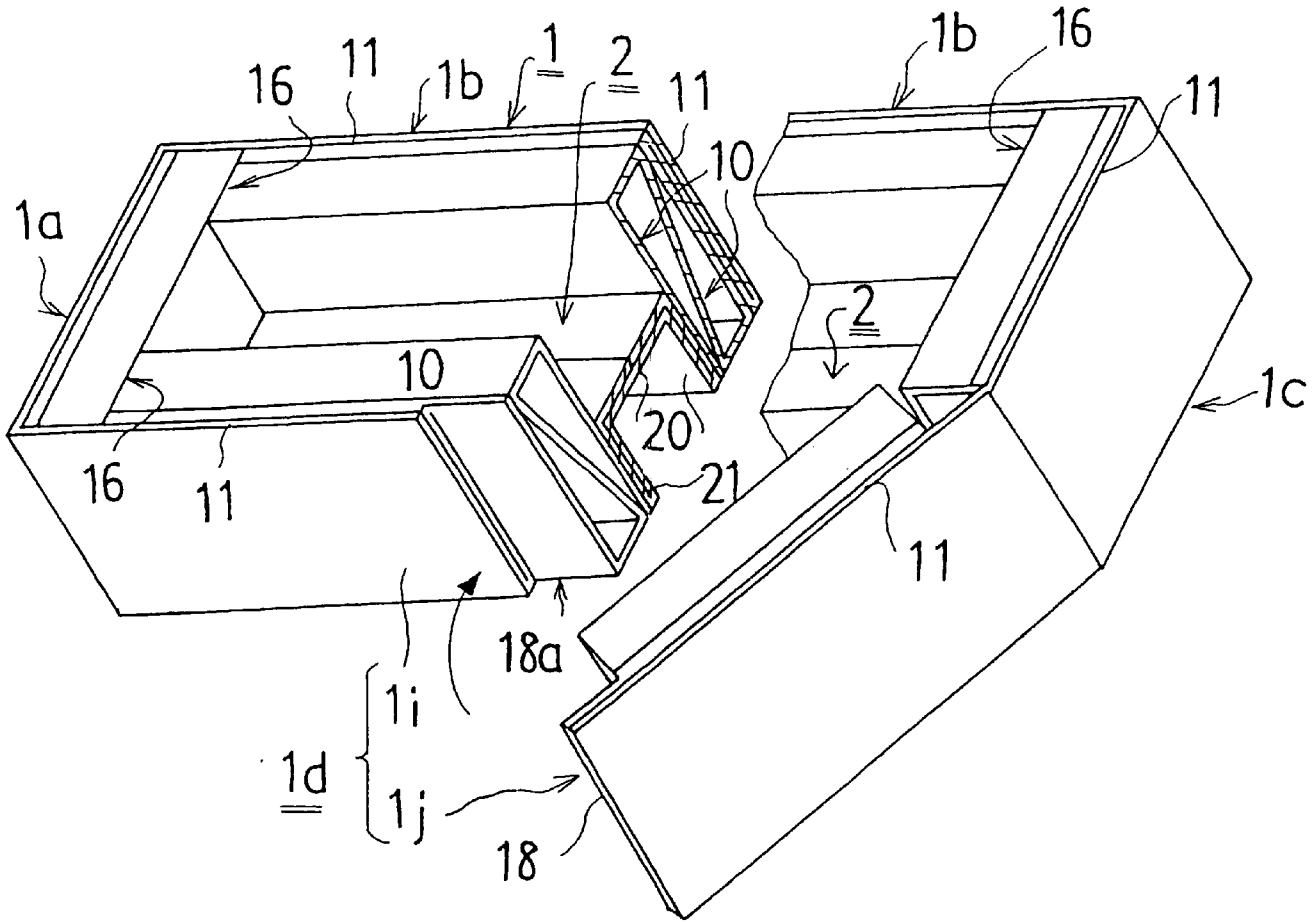
FIG. 17 is a partially broken-away perspective view showing a cushioning material for packaging in the ninth embodiment according to the present invention.

FIG. 17 shows a ninth embodiment as including outer side sheet portions 11 of frame members 1*a* to 1*d* formed of a plurality of layers (three layers) resulting from folding portions of the sheet, and the adjacent frame members and also the first and fourth frame members 1*a*, 1*d* are connected together through the outermost layer of the outer side sheet portions 11.

The fourth frame member 1*d* is divided into two separate portions 1*i*, 1*j* by a cut through the hollow portions 10 close to the center thereof.

The butted ends of the separate portions 1*i*, 1*j* have joint portions 18, 18*a* connected to the portions of the outer side sheet portions 11 by bonding such that a substantially continuous outer side surface may be formed when the ends of both the separate portions 1*i*, 1*j* are butted against each other.

One joint portion 18 is an overlapping portion formed by extending layers of the outer side sheet portion 11 of the separate portion 1*j*, while the other joint portion 18*a* is a joint portion in which layers of the outer side sheet portion 11 are cut back to provide a recess in the shape of the overlapping portion. The separate portions 1*i*, 1*j* are connected together by bonding, with one joint portion 18 fitted within the other joint portion 18*a*.

A raised bottom member 2 having side leg portions 21, 21 depending from the opposite sides of a top sheet portion 20 is inserted into the center of the frame 1 formed of the frame members 1*a*, 1*d*. The raised bottom member 2 is reinforced with the top sheet portion 20 and the side leg portions 21 respectively formed of a plurality of layers, and a high cushioning effect is provided by the raised bottom member.

According to the cushioning material for packaging in the ninth embodiment, since the continuous frame members 1*a* to 1*d* may be easily connected into the shape of a closed loop by the joint portions 18, 18*a*, when these frame members are assembled into shape of a frame it is possible to improve efficiency in the process of packing an article.

Further, since the outer side sheet portions 11 of the frame members 1*a* to 1*d* are formed of a plurality of sheet layers, the frame members 1*a* to 1*d* are strengthened, and the cushioning effect is further improved.

Other features, operation and effects of the cushioning material for packaging in the ninth embodiment are substantially similar to those of the cushioning material in the first embodiment, and hence, the description thereof will be omitted.

Tenth Embodiment

Figure 18:
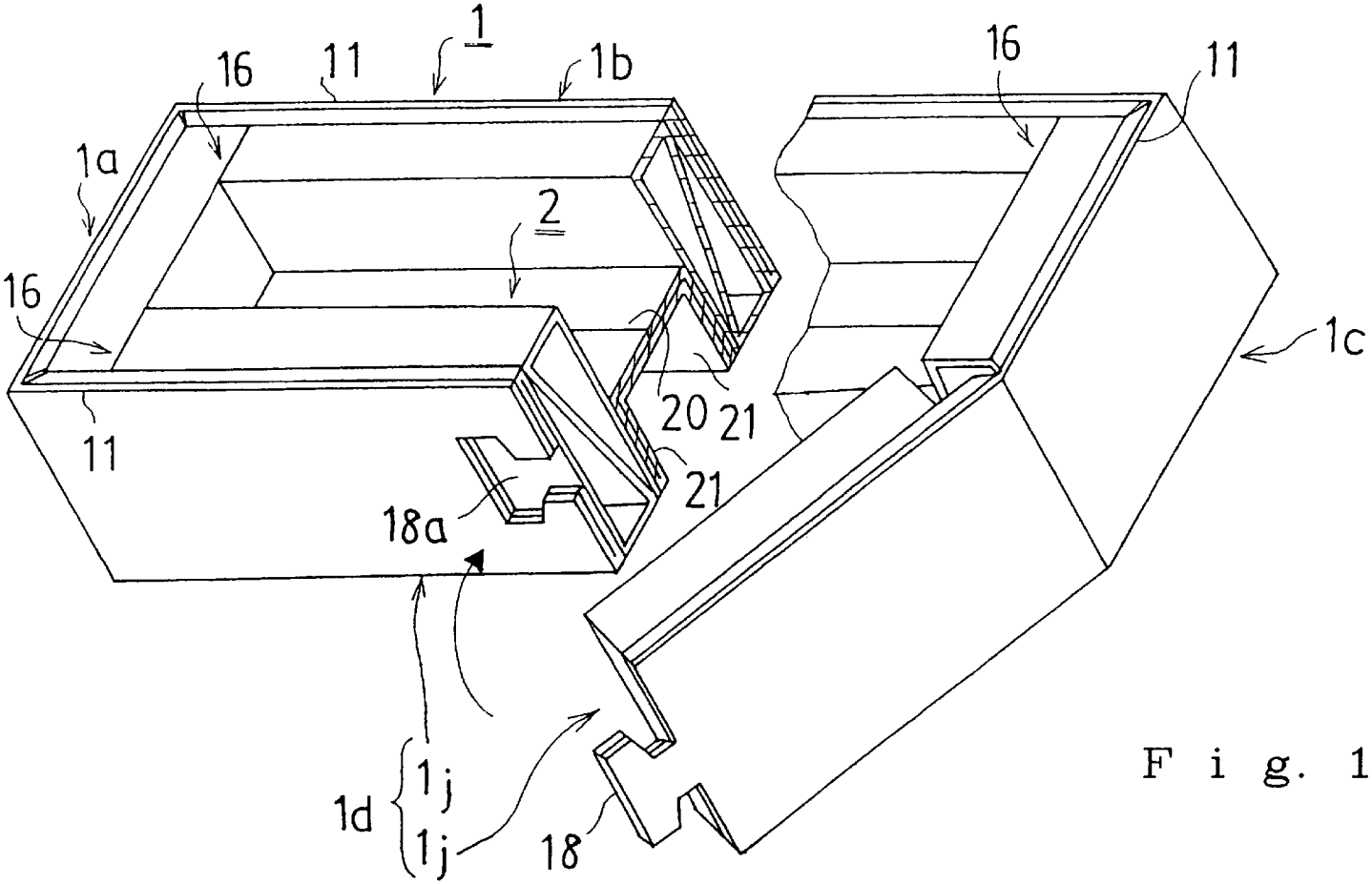
FIG. 18 is a partially broken-away perspective view showing a cushioning material for packaging in the tenth embodiment according to the present invention.

FIG. 18 shows a tenth embodiment which includes another design of the joint portions 18, 18*a* of the cushioning material. The end portion of one separate portion 1*j* of the fourth frame member 1*d* has a joint portion 18 in the shape of an engaging T-shaped projection formed of a layer portion of the outer side sheet portion 11, while the end portion of the other separate portion 1*j* has a joint portion 18*a* in the shape of the projection formed by cutting out a layer portion of the outer side sheet portion 11 so as to mate with the joint portion 18. The frame members 1*a* to 1*d* are formed into the shape a frame by connecting the separate portions 1*i*, 1*l* together by inserting or fitting the joint portion 18 in the shape of the engaging projection into the joint portion 18*a* which is a recess in the shape of the projection.

According to the tenth embodiment, since the frame members 1*a* to 1*d* are connected into the shape of a rectangular frame through the engagement of the joint portions 18, 18*a*, it is possible to further improve working efficiency in the process of packing an article.

Other features, operation and effects of the cushioning material in the tenth embodiment are similar to those of the cushioning material in the ninth embodiment, and hence, the description thereof will be omitted.

Eleventh Embodiment

Figure 19:
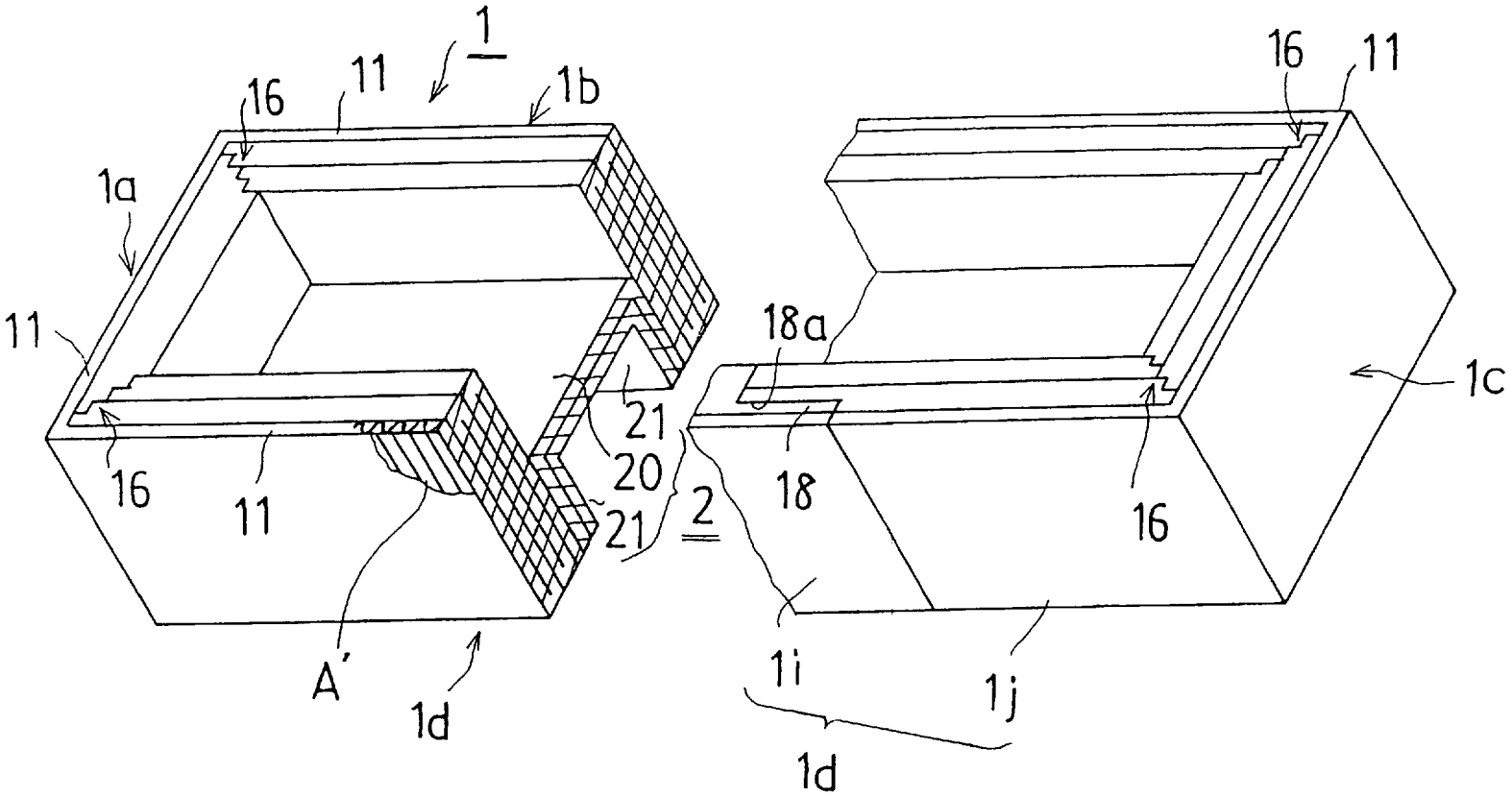
FIG. 19 is a partially broken-away perspective view showing a cushioning material for packaging in the eleventh embodiment according to the present invention.
Figure 20:
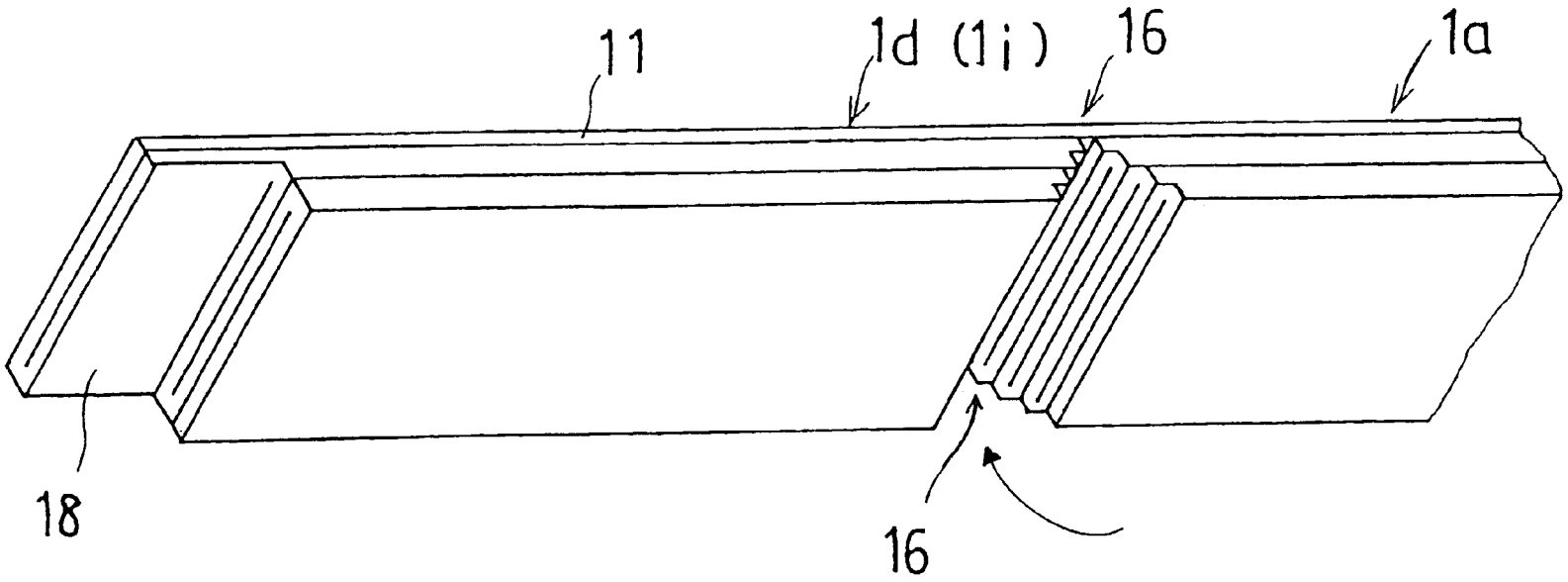
FIG. 20 is a partial perspective view showing joint structures of the cushioning material for packaging of FIG. 19.

FIGS. 19 and 20 show an eleventh embodiment of the cushioning material for packaging in the form of rectangular frame 1 composed of first to fourth frame members 1*a* to 1*d* which have layered sides obtained by folding the sheet and the outer layers of the upper and lower folding portions are bonded together to maintain the layered state of the sides. Flutes A' of the sheet are arranged in parallel to the height dimension of outer side sheet portions 11.

The ends of the adjacent frame members 1*a* to 1*d* are connected together through the outer side sheet portions 11, and the connecting end portions of the frame members are cut at an angle of about *45* degrees in a zigzag shape with the outer side sheet portions 11 left as they are. The joint structures 16 may be formed similarly to those of the cushioning material in the first and eighth embodiments.

The first and fourth frame members 1*a*, 1*d* are also connected together through the outer side sheet portions 11, portions 1*i*, 1*j*, and the butted ends of the separate portions 1*i*, 1*j* have joint portions 18, 18*a*.

One joint portion 18 is an overlapping portion formed as an extension of a sheet layer of a portion of the outer side at the end of one separate portion 1*i*, while the other joint portion 18*a* is a joint portion in the form of a cutout of a portion of the outer side at the end portion of the other separate portion 1*j*.

The frame members 1*a* to 1*d* connected together through the uncut outer edge portion are folded into a rectangular frame 1 as shown in FIG. 19 and the joint portions 18, 18*a* are bound together in layers such that the fourth frame member 1*d* may have a substantially uniform perpendicular outer side surface.

A raised bottom member 2 having a top sheet portion 20 composed of two layers of a sheet formed of a corrugated cardboard and two-layered side leg portions 21, 21, formed depending from the opposite sides of the top sheet portion, is mounted (inserted) inside of the frame 1.

According to the cushioning material for packaging in the eleventh embodiment, since the frame members 1*a* to 1*d* are formed of layered bodies resulting from folding the sheet formed of the corrugated cardboard in layers and thus ensure higher strength, this cushioning material displays an excellent cushioning effect due to the flutes of the sheet in each layer.

The cushioning material in the eleventh embodiment may be formed to have the joint portions 18, 18*a* similar to those of the cushioning material in the tenth embodiment, or otherwise, a fixing sheet portion 17 similar to that in the cushioning material in the fourth embodiment, for instance, may be formed, instead of the joint portions 18, 18*a*, by uniting the separate portions 1*i*, 1*j* of the fourth frame member 1*d* together and then extending the outer side sheet portion 11 at the end of this frame member 1*d*.

Other features, operation and effects of the cushioning material in the eleventh embodiment are substantially similar to those of the cushioning material in the eighth embodiment and hence, the description thereof will be omitted.

Twelfth Embodiment

Figure 21:
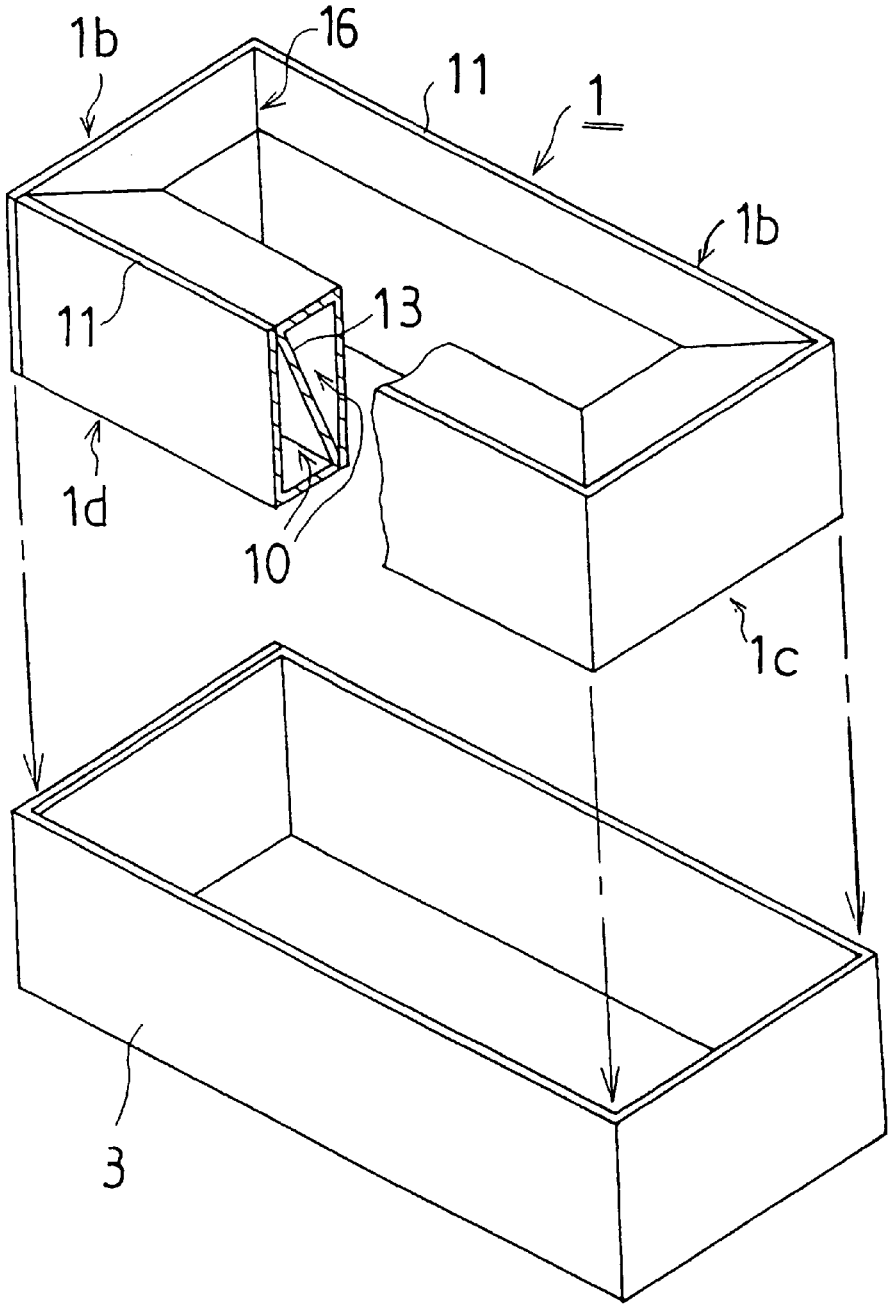
FIG. 21 is a partially broken-away exploded perspective view showing a cushioning material for packaging in the twelfth embodiment according to the present invention.

FIG. 21 shows a cushioning material for packaging in the twelfth embodiment, wherein an outer frame 3 in the shape of a closed loop having a horizontally inner periphery substantially fitted to the horizontally outer periphery of a frame 1 is formed of a foldable sheet such as a corrugated cardboard, thick paper or the like, and a frame 1 formed by connecting frame members 1*a* to 1*d* together into the shape of a frame is inserted into the outer frame 3, so that the frame 1 is restrained by the outer frame 3 from losing its frame shape.

Since the cushioning material for packaging in the twelfth embodiment does not need any bonding process to join the connected frame members 1*a* to 1*d* together in the shape of a frame, the process of packing an article is further simplified, resulting in a reduction in packing cost.

Thirteenth Embodiment

Figure 22:
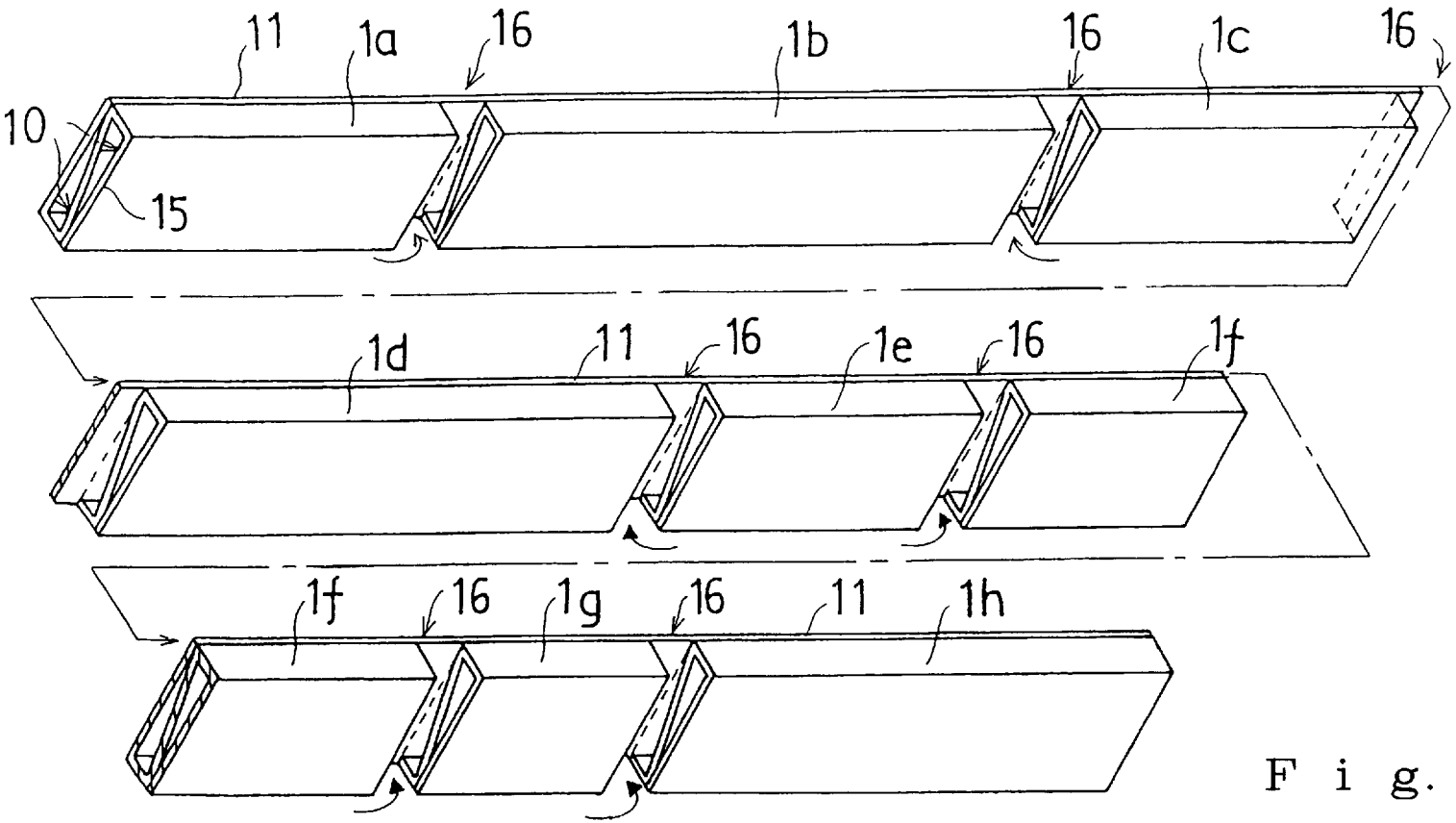
FIG. 22 is a perspective view showing the semi-folded state of a cushioning material for packaging in the thirteenth embodiment according to the present invention.
Figure 23:
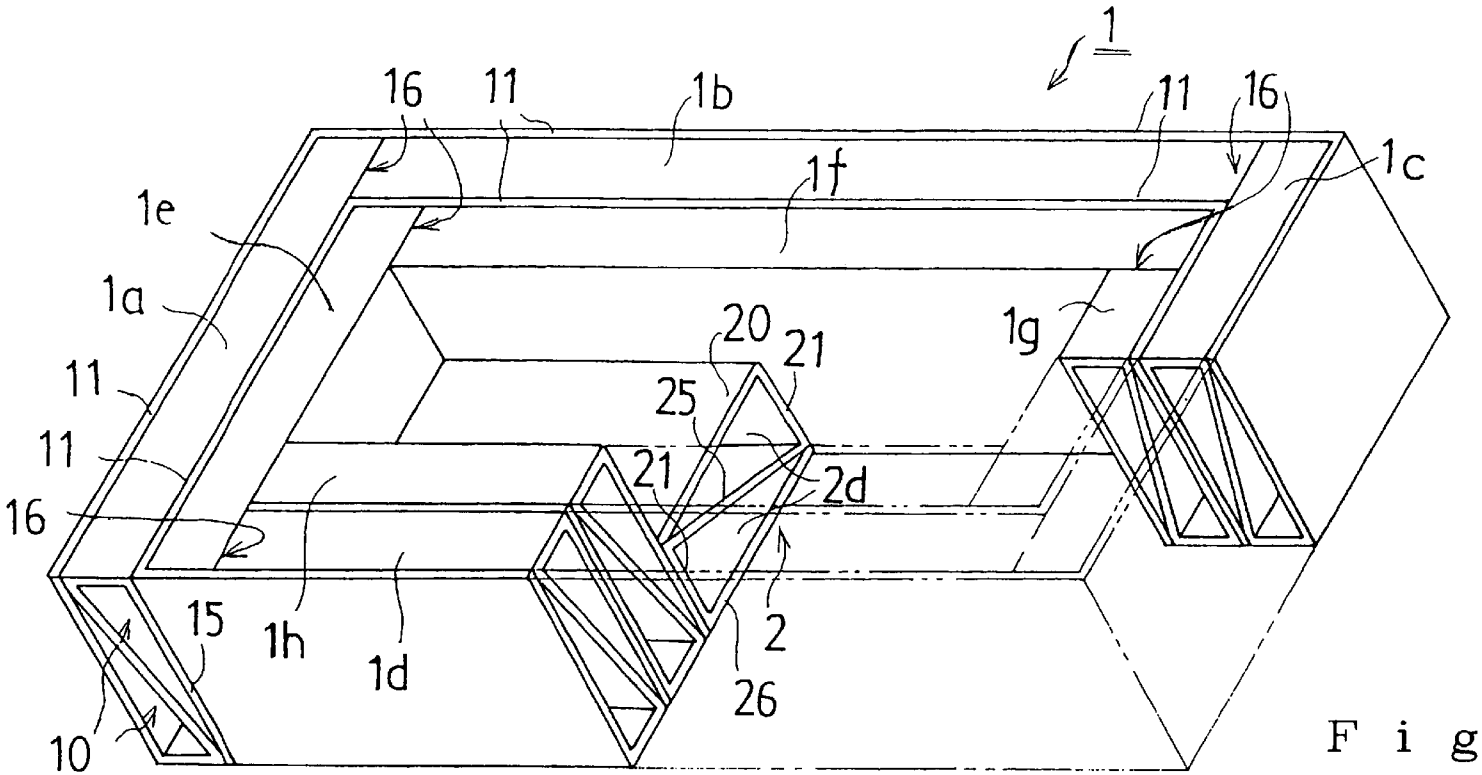
FIG. 23 is a partially broken-away perspective view showing the assembled state of the cushioning material for packaging of FIG. 22.

FIGS. 22 and 23 show a cushioning material for packaging in a fifteenth embodiment of the invention.

As shown in FIG. 22, first to eighth frame members 1*a* to 1*h* are formed of similar material in a similar cross sectional shape as the frame members in the first embodiment, and are connected together in a row in order through outer side sheet portions 11.

The end portions of the adjacent frame members, of the frame members 1*a* to 1*h*, have joint structures 16 for combining the frame members together at right angles to each other with the outer side sheet portions if left as they are.

A horizontally rectangular frame 1 as shown in FIG. 23 is formed by the process of respectively combining the seventh and eighth frame members 1*g*, 1*h*, the sixth and seventh frame members 1*f*, 1*g*, the fifth and sixth frame members 1*e*, 1*f*, the fourth and fifth frame members 1*d*, 1*e*, the third and fourth frame members 1*c*, 1*d*, the second and third frame members 1*b*, 1*c* and the first and second frame members 1*a*, 1*b*, as shown in FIG. 22, together in order at right angles to a plane and then bonding inner side sheet portion 15 of the first frame member 1*a* and the outer side sheet portion 11 of the fifth frame member 1*e* together.

Thus, the frame 1 is formed as a double frame such that the first and fifth frame members 1*a*, 1*e*,the second and sixth frame members 1*b*, if, the third and seventh frame members 1*c*, 1*g*, the fourth and eighth frame members 1*d*, 1*h* are respectively parallel to each other.

A raised bottom member 2 is mounted (inserted) inside the frame 1.

The raised bottom member 2 is formed by folding a sheet such as a corrugated cardboard, and has a top sheet portion 20, one side leg portion 21 connected at its upper end to the top sheet portion 20, an inclined partition sheet portion 25 connected to the lower end of one side leg portion 21 and also to the upper end of the other side leg portion 21 and a bottom sheet portion 26 connected to the lower end of the other side leg portion 21. Since two hollow portions 2*d*, 2*d* constitute the raised bottom member 2 and extend longitudinally of the frame 1, and the contour and sizes of cross-sections of these hollow portions are equal to each other, the raised bottom member 2 is formed in a rectangular cross-sectional shape.

According to the cushioning material for packaging in the thirteenth embodiment, since the edge members of the frame 1 are composed of the doubled frame members 1 formed of the parallel hollow bodies so that the collapse of two hollow bodies rarely occurs at the same time even when receiving a great shock, this cushioning material displays an excellent shock resisting effect.

Since the raised bottom member 2 has two hollow portions 2*d*, and these hollow portions 2*d* are subjected to deformation and restoration when the shock is received, a cushioning effect is further improved.

Other features, operation and effects of the cushioning material in the thirteenth embodiment are similar to those of the cushioning material for packaging in the second embodiment, and hence, the description thereof will be omitted.

Figure 24:
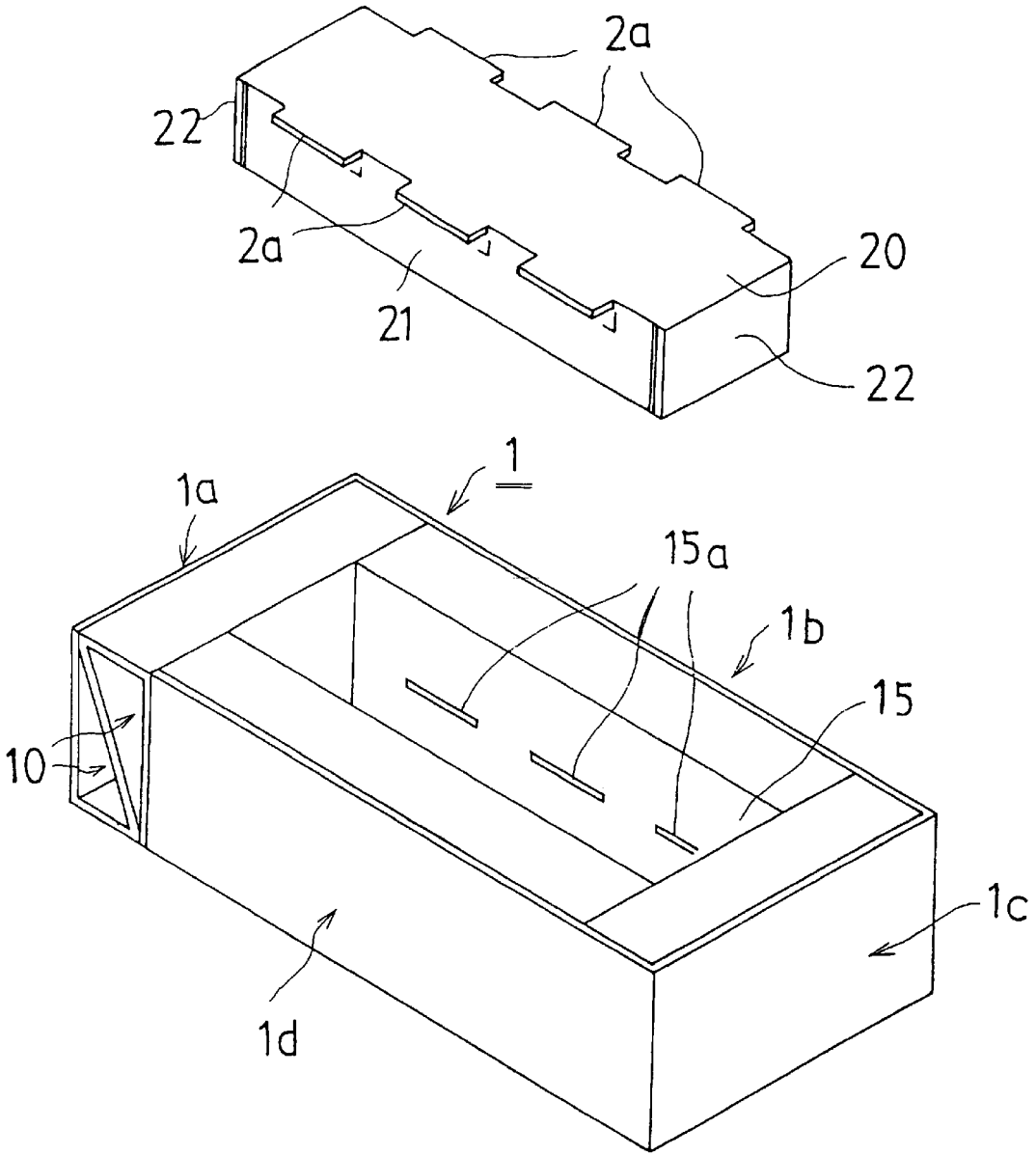
FIG. 24 is an exploded perspective view showing a cushioning material for packaging in the fourteenth embodiment according to the present invention.

FIG. 24 shows a cushioning material for packaging in another embodiment of the invention wherein a rectangular frame 1 is composed of first to fourth frame members 1*a* to 1*d* similar in structure to the frame members in the first embodiment, except that inner side sheet portions 15 of the second and fourth frame members 1*b*, 1*d* facing each other have horizontal slits 15*a* arranged substantially in the center of their vertical dimension.

A box-shaped raised bottom member 2 has a top sheet portion 20, side leg portions 21, 21 and end leg portions 22, 22, and the opposing sides of the top sheet portion 20 have horizontally extending projections 2*a* at positions corresponding to the slits 15*a*.

The raised bottom member 2 is mounted in an appropriate position inside of the frame 1 with the projections 2*a* inserted in their corresponding slits 15*a* and the raised bottom member 2 inserted into the frame 1.

Since the cushioning material for packaging in this embodiment does not need any bonding process for mounting the raised bottom member 2 inside the frame 1, the process of packing an article is further simplified, resulting in a further reduction in packing cost.

Other features, operation and effects of the cushioning material in this embodiment are similar to those of the cushioning material in the first embodiment, and hence, the description thereof will be omitted.

Fifteenth Embodiment

Figure 25:
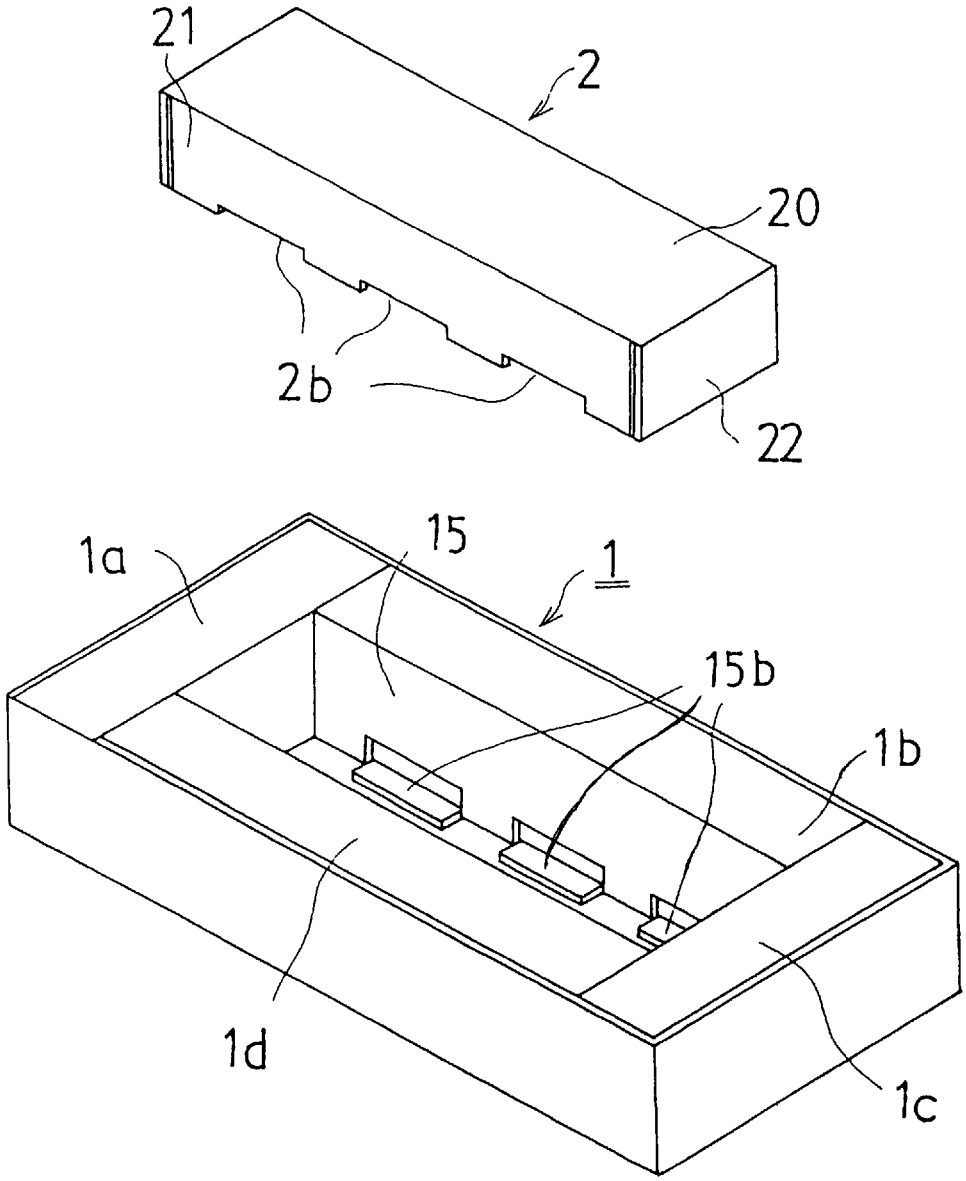
FIG. 25 is an exploded perspective view showing a cushioning material for packaging in the fifteenth embodiment according to the present invention.

FIG. 25 shows a cushioning material for packaging in a further embodiment wherein inside sheet portions 15 of the opposing frame members 1*b*, 1*d* of a frame 1, similar in structure to the frame 1 in the fourteenth embodiment, have horizontally extending flanged projections 15*b*.

A raised bottom member 2, similar in basic structure to the raised bottom member 2 in the fourteenth embodiment, has side leg portions 21, 21 with notch portions 2*b* at positions corresponding to the projections 15*b*.

The raised bottom member 2 is mounted in an appropriate position inside the frame 1 so as to guide the projections 15*b* into the corresponding notch portions 2*b* in the inserting of the raised bottom member 2 into the frame 1.

Since the cushioning material for packaging in the fifteenth embodiment does not need any bonding process in the case of mounting the raised bottom member 2 inside the frame 1, the process of packing an article is further simplified, resulting in a further reduction in packing cost.

Other features, operation and effects of the cushioning material in the fifteenth embodiment are similar to those of the cushioning material in the first embodiment, and hence, the description thereof will be omitted.

Sixteenth Embodiment

FIG. 26 shows another embodiment of the raised bottom member 2 in the shape of a flanged tray. The manufacture of this raised bottom member 2 involves cutting a planar sheet A5 as shown in FIG. 26(*a*), for instance. The opposite sides of a bottom sheet portion 26 in the center of the sheet A5 have side sheet portions 27 and flange sheet portions 29 connected through V-shaped folds a1 and inverse V-shaped folds a2, in order. The opposing ends of the bottom sheet portion 26 have end sheet portions 28 and flange sheet portions 29 formed in order through V-shaped folds a1 and inverse V-shaped folds a2 in order, and the opposite sides of the end sheet portions 28 have flaps 24 formed through the V-shaped folds a1.

Subsequently, when the sheet A5 cut as shown in FIG. 26(*a*) is folded along the folding direction of the folds a1, a2, and the flaps 24 are bonded to the end portions of their corresponding side sheet portions 27, the raised bottom member 2 has the flange sheet portions 29 at the upper side and a body in the shape of a tray as shown in FIGS. 26(*b*) to 26(*d*). When the body in the shape of the tray is inserted into the frame 1 of the first embodiment, for instance, the flanges 29 contact the upper surface of the frame 1, so that it is possible to very easily mount the raised bottom member 2 inside the frame 1 in the process of packing an article.

Seventeenth Embodiment

FIG. 27 shows a further embodiment of the raised bottom member 2 wherein bottom member 2 is cut from a sheet A5 formed of a corrugated cardboard, for instance, as shown in FIG. 27(*a*). The opposite sides of a top sheet portion 20 in the center of the sheet A5 have side leg portions 21 formed through inverse V-shaped folds a2. The opposite end portions of the top sheet portion 20 have end leg portions 22 formed through inverse V-shaped folds a2, and the opposite sides of the end leg portions 22 have flaps 24 formed through inverse V-shaped folds a2.

Sheet portions corresponding to the lower end portions of the side leg portions 21, the end leg portions 22 and the flaps 24 have semicircular notch portions 2C, for instance, at proper intervals.

When the sheet A5 cut as shown in FIG. 27(*a*) is folded along the folds a2, and the flaps 24 are bonded to the inner side of the end portions of their corresponding side leg portions 21, the raised bottom member 2 as shown in FIGS. 27(*f*) to 27(*h*) is completed.

When the raised bottom member 2 having the above structure is inserted into the frame 1 in the fifth embodiment, for instance, the leg portions 21, 22 are held at proper positions in contact with the corresponding inner side sheet portions 15 of the frame 1.

Since it is very easy to mount the raised bottom member 2 having the above structure in the frame 1 when this raised bottom member is used together with a frame 1 having the sharply inclined inner surface as described above, the process of packing an article is further simplified, resulting in a further reduction in packing cost.

Further, since the raised bottom member 2 is wholly reinforced by the overlap-width flaps 24, higher strength of the raised bottom member 2 is ensured, while its cushioning effect is improved.

Furthermore, since the lower ends of the leg portions 21, 22 have the large number of notch portions 2*c*, it is possible to improve the cushioning effect against a load on the leg portions 21, 22 in the vertical direction.

Eighteenth Embodiment

Figure 28:
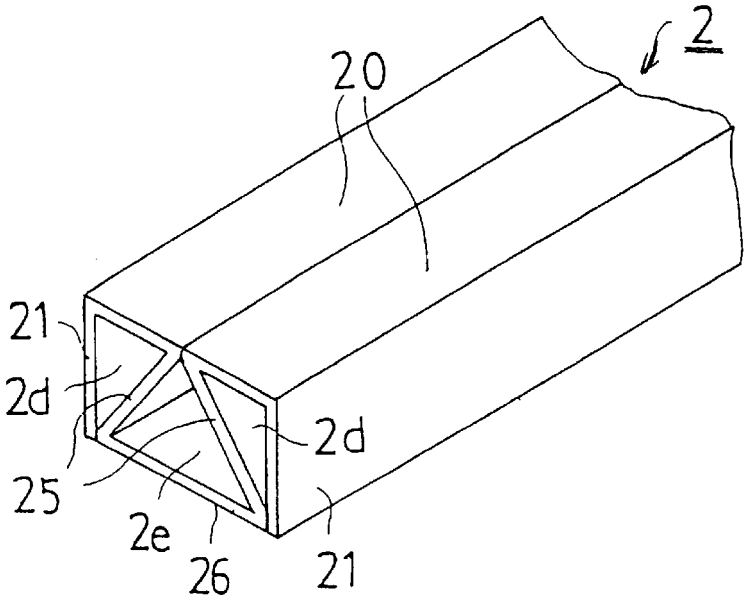
FIG. 28 is a partial perspective view showing a still further embodiment of a raised bottom member.

FIG. 28 shows a still further embodiment of the raised bottom member 2 which is manufactured by the process of folding a sheet formed of a corrugated cardboard, for instance, and then bonding the required portions of the sheet together, and which has one substantially perpendicular side leg portion 21, one top sheet portion 20 connected along one edge to the upper end of the side leg portion 21, one inclined partition sheet portion 25 connected to the other edge of the one top sheet portion 20, a bottom sheet portion 26 connected to the lower end of the one partition sheet portion 25, the other inclined partition sheet portion 25 connected to the edge of the bottom sheet portion 26, the other top sheet portion 20 connected to the upper edge of the other partition sheet portion 25 and the other side leg portion 21 connected to the edge of the other top sheet portion 20.

The raised bottom member 2 has a hollow portion 2*e* of an isosceles triangular cross-sectional shape and hollow portions 2*d* of a right angled triangular cross-sectional shape positioned on the opposite sides of the hollow portion 2*e*. The hollow portions 2*e*, 2*d* are arranged in parallel with the longitudinal dimension thereof, and the exterior contour of cross-section of the raised bottom member is square.

The raised bottom member 2 shown in FIG. 28, since a vertical load is supported by the opposite side leg portions 21, 21 and the partition sheet portions 25, 25 having the tops making contact with each other in the center of the top surface, has higher strength against a vertical load. Further, since a shock is absorbed by deforming the inclined partitions 25 so as to be bent depending on the acting direction of the external force, this raised bottom member displays a more excellent cushioning effect.

Since the raised bottom member 2 is manufactured by the process of folding the sheet along the folds arranged in parallel in a fixed direction and then bonding the outer sides of the folding portions together, the manufacture cost is further reduced.

Nineteenth Embodiment

Figure 29:
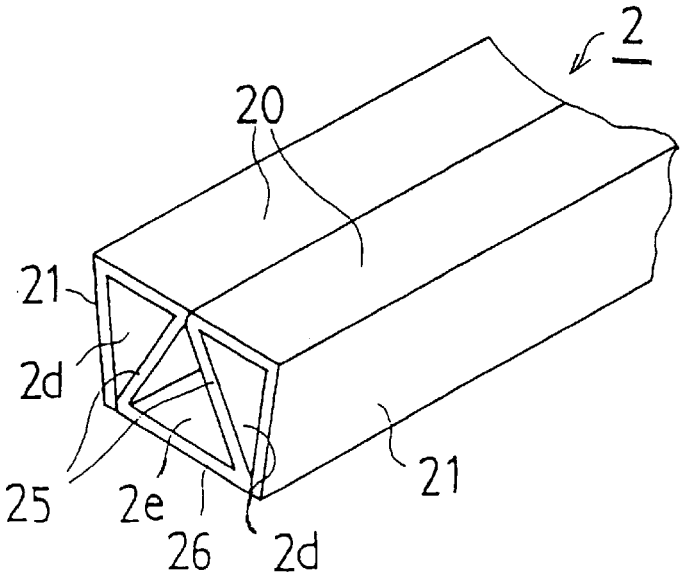
FIG. 29 is a partial perspective view showing a yet further embodiment of a raised bottom member.

FIG. 29 shows a yet further embodiment of the raised bottom member 2 which is similar to the raised bottom member 2 in the eighteenth embodiment except that the width of a bottom sheet portion 25 is made narrower than the total width of left and right top sheet portions 20, 20 to form side leg portions 21, 21 sharply inclined in the reverse direction.

When this raised bottom member 2 is inserted into the frame 1 in the fifth embodiment, for instance, the leg portions 21, 21 are held at proper positions in contact with the corresponding inner side sheet portions 15 of the frame 1. Thus, since it is very simple to mount the raised bottom member in the frame 1, the process of packing an article is simplified, resulting in a further reduction in packing cost.

Other features, operation and effects of the raised bottom member 2 in the nineteenth embodiment are substantially similar to those of the raised bottom member in the eighteenth embodiment.

Twentieth Embodiment

Figure 30:
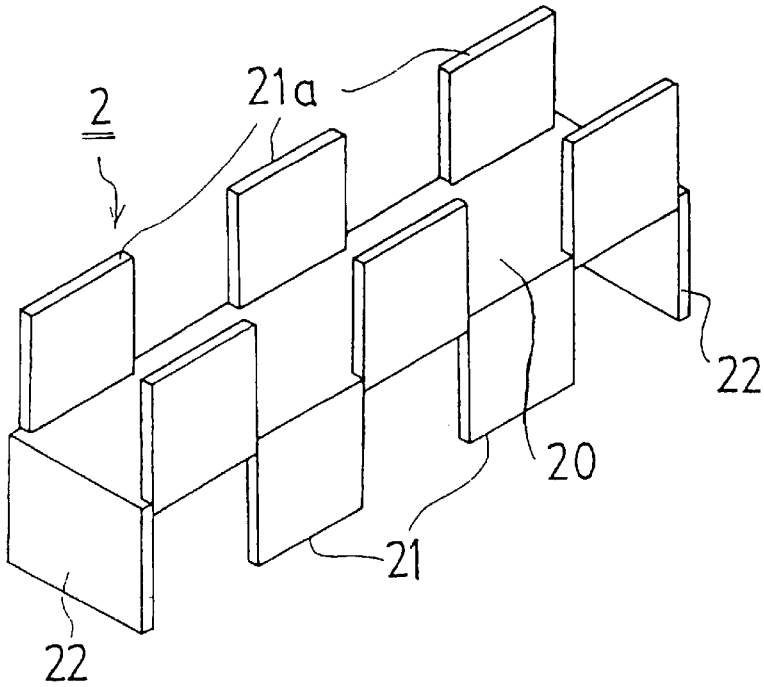
FIG. 30 is a perspective view showing a yet further embodiment of a raised bottom member.

FIG. 30 shows a yet further embodiment of the raised bottom 2 which has end leg portions 22, 22 formed in one body at the opposite end portions of a top sheet portion 20 formed of a sheet such as a corrugated cardboard, a plurality of end leg portions 21 formed below the opposite sides of the top sheet portion 20 and a plurality of upper side leg portions 21*a* formed above the opposite sides of the top sheet portion 20 in the manner of alternating the upper side leg portions 21*a* with the lower side leg portions 21.

When this raised bottom member 2 is mounted inside the frame 1 of the first embodiment, for instance, there is an advantage in that this raised bottom member 2 allows insertion of the end of an article to be packaged not only from the upper side but also from the lower side thereof.

Twenty-first Embodiment

Figure 31:
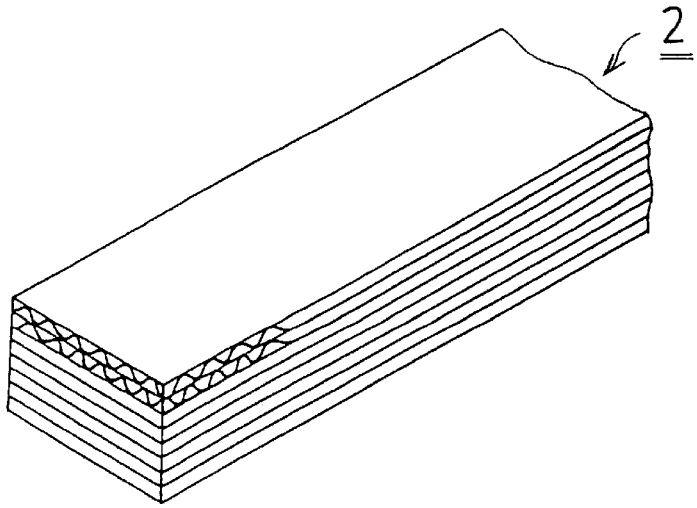
FIG. 31 is a partial perspective view showing yet a further embodiment of a raised bottom member.
Figure 32:
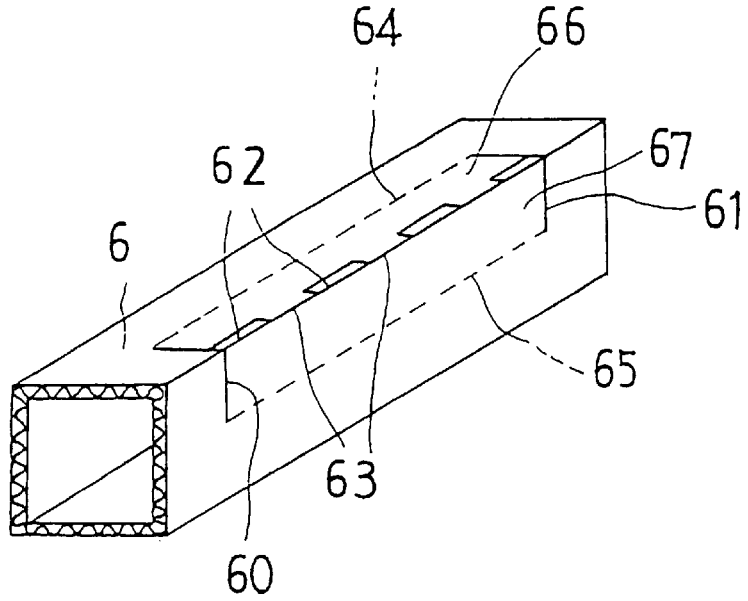
FIG. 32 is a perspective view showing the state of a cushioning material for packaging in the prior art before completion.
Figure 33:
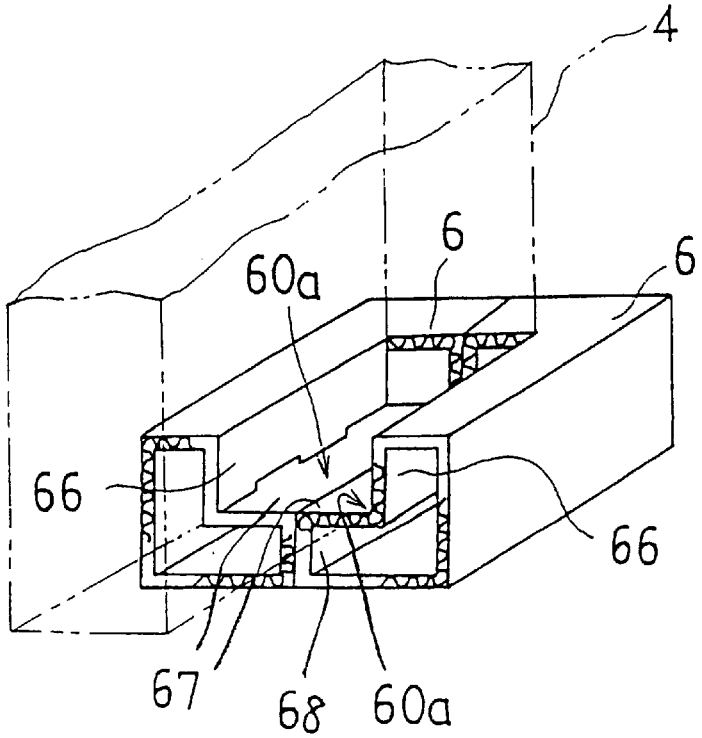
FIG. 33 is a partial perspective view showing use of a cushioning material for packaging in the prior art.

FIG. 31 shows a yet further embodiment of the raised bottom member 2 formed by laminating a sheet formed of a corrugated cardboard in layers, and displays an extremely excellent cushioning effect against a vertical load in the case of mounting this raised bottom member of FIG. 31 in the inserted state to the inside of the frame 1 in the first embodiment, for instance.

While each of the above embodiments has been described as forming the cushioning material by making use of a sheet formed of corrugated cardboard, it is to be understood that thick paper and other foldable and recyclable sheet may be used to manufacture the cushioning material.

Further, in the case of using the sheet formed of the corrugated cardboard, it is possible to employ a double wall corrugated cardboard formed such that flutes of layers of the corrugating medium are crosswise to each other.

What is claimed is:

1. A cushioning material for packaging, comprising:

first and third frame members for forming a pair of parallel edge members of a rectangular frame; and second and fourth frame members for forming the other pair of parallel edge members of said frame;

wherein said first, second, third and fourth frame members are formed of hollow bodies longitudinally divided into a plurality of parallel hollow sections, the contour and sizes of cross sections through the hollow sections being substantially the same, wherein the hollow bodies constituting said frame members are formed in a row by folding a single foldable sheet, wherein adjacent frame members are connected through a single uncut side portion of said sheet which is positioned on the outer side when the frame members are assembled into the rectangular frame, and the end portions of adjacent frame members have joint structures for combining the frame members together at right angles to each other.

2. A cushioning material for packaging according to claim 1 wherein the contour of cross sections of said frame members is rectangular, and wherein partition sheet portions inclined relative to outer sides of said frame members, longitudinally divide the frame members into two parallel hollow sections.

3. A cushioning material for packaging according to claim 1, wherein the contour of cross sections of said frame members is trapezoidal such that inner side sheet portions facing outer side sheet portions of said frame members are sharply inclined to said outer side sheet portions, and partition sheet portions, inclined to said outer side sheet portions, longitudinally divide the frame members into two parallel hollow sections.

4. A cushioning material for packaging according to claim 3 folded into a rectangular shape and joined to a raised bottom member provided on the inside of said frame and having leg portions making contact with inner side sheet portions of the frame members forming at least a pair of parallel edge members of said frame, said raised bottom member being formed of layers.

5. A cushioning material for packaging according to claim 1, wherein said frame members have outer side portions positioned on the outer side when said frame members are assembled into a rectangular frame, and inner side portions in parallel and in contact with corresponding outer side portions when said frame members are assembled into the rectangular frame, said inner side portions being equal in height to said outer side portions, said inner side and outer side portions being each longitudinally divided into said parallel hollow portions and all formed by folding a single sheet.

6. A cushioning material for packaging according to claim 1, wherein said frame members have said uncut side portions in substantially perpendicular positions, and are composed of first portions positioned on the outer side when said frame members are assembled into a square frame, and second portions continuously positioned on the inner side of said first portions in parallel when said frame members are assembled into the square frame, said second portions being smaller in height than said first portions.

7. A cushioning material for packaging according to claim 1, wherein said uncut side portions are formed of a plurality of layers resulting from folding portions of said sheet.

8. A cushioning material for packaging according to claim 1, wherein one of said said first frame member and said fourth frame member has a fixing sheet portion formed as an extension of said uncut side portion to fix the extended side portion to an outer side surface of the other of said first and fourth frame members.

9. A cushioning material for packaging, according to claim 1 in the form of an inner frame of a rectangular shape, said inner frame being provided with an outer frame in the shape of a closed loop making contact with outer side surfaces of said inner frame.

10. A cushioning material for packaging according to claim 1 formed into an outer side frame of a rectangular shape and joined to another said cushioning material formed into an inner side frame of a rectangular shape and in contact with inner side surfaces of said outer side frame.

11. A cushioning material for packaging according to claim 10, wherein said inner side frame is smaller in height than said outer side frame.

12. A cushioning material for packaging according to claim 1, in the form of a frame of a rectangular shape.

13. A cushioning material for packaging, comprising:

first and third frame members for forming a pair of parallel edge members of a rectangular frame; and second and fourth frame members for forming the other pair of parallel edge members;

wherein said first, second, third and fourth frame members are formed as layers of a single foldable sheet, wherein the frame members are connected by outer side sheet portions which are positioned on the outer side when said frame members are assembled into a rectangular frame, wherein free ends of said first and fourth frame members have joint structures for combining the frame members together at right angles to each other to form the rectangular frame.

14. A cushioning material for packaging according to claim 13, wherein said joint structures are structured such that the end of one of said frame members is brought into contact with the side surface of an adjacent frame member, and the end portions of adjacent frame members are brought into contact with each other after said end portions are cut at an angle of about 45 degrees with said outer side sheet portions left intact.

15. A cushioning material for packaging according to claim 13, wherein said first and fourth frame members are connected together, one said first frame member and fourth frame member is divided into two separate portions by a cut intersecting said hollow portions, and butted ends of the two separate portions have joint portions connected together such that the outer side surface forms a substantially uniform surface when both the separate portions are butted against each other.

16. A cushioning material for packaging according to claim 13, in the form of a frame of a rectangular shape.

17. A cushioning material for packaging, comprising:

first and third frame members forming a pair of parallel edge members of a rectangular frame;

second and fourth frame members forming the other pair of parallel edge members of said frame;

a fifth frame member positioned in parallel on the inner side of said first frame member;

a sixth frame member positioned in parallel on the inner side of said second frame member;

a seventh frame member positioned in parallel on the inner side of said third frame member; and an eighth frame member positioned in parallel on the inner side of said fourth frame member;

wherein said frame members are formed of hollow bodies longitudinally divided into a plurality of parallel hollow sections, the contour and sizes of cross sections through said hollow sections being substantially the same, wherein the hollow bodies constituting said frame members are formed in a row by folding a single sheet, wherein adjacent frame members are connected through a single uncut side sheet portion of said sheet which is positioned on the outer side when said frame members are assembled into the rectangular frame, and the end portions of adjacent frame members have joint structures for combining the frame members together at right angles to each other.

18. A cushioning material for packaging according to claim 17, wherein a raised bottom member, formed by folding a foldable sheet, is provided on the inside of said frame.

19. A cushioning material for packaging formed of a single sheet defined by opposing edges and opposing longitudinal sides spanning and longer than said edges;

cutouts extending from one of said longitudinal sides and terminating spaced from the other longitudinal side, leaving an uncut strip at said other longitudinal side, said cutouts dividing a main portion of said sheet into four sections which are folded onto said uncut strip to form first, second, third and fourth frame members which are separated with lengths of said uncut strip therebetween, said lengths becoming corners of a rectangular frame when free ends of said first and fourth frame members are joined together;

wherein each of said frame members is longitudinally divided into a pair of parallel hollow sections by a diagonal fold of one of said four sections, said parallel hollow sections each having a cross-section divided into two right-angle triangles of the same size by said diagonal fold.

* * * * *